US006801749B2

(12) United States Patent
Yasui et al.

(10) Patent No.: US 6,801,749 B2
(45) Date of Patent: Oct. 5, 2004

(54) APPARATUSES FOR COLOR IMAGE FORMATION, TANDEM COLOR IMAGE FORMATION AND IMAGE FORMATION

(75) Inventors: Motokazu Yasui, Kanagawa (JP); Hiroyasu Shijo, Kanagawa (JP); Masumi Sato, Kanagawa (JP); Tomotoshi Nakahara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/390,792

(22) Filed: Mar. 19, 2003

(65) Prior Publication Data

US 2003/0180079 A1 Sep. 25, 2003

Related U.S. Application Data

(62) Division of application No. 09/962,899, filed on Sep. 26, 2001, now Pat. No. 6,567,643.

(30) Foreign Application Priority Data

| | | |
|---|---|---|
| Sep. 27, 2000 | (JP) | 2000-293937 |
| Sep. 27, 2000 | (JP) | 2000-293938 |
| Oct. 31, 2000 | (JP) | 2000-333272 |
| Nov. 29, 2000 | (JP) | 2000-363163 |
| Aug. 30, 2001 | (JP) | 2001-261950 |
| Aug. 30, 2001 | (JP) | 2001-261951 |
| Aug. 30, 2001 | (JP) | 2001-261952 |

(51) Int. Cl.[7] ..... G03G 15/00; G03G 15/01; G03G 21/00

(52) U.S. Cl. ..... 399/401; 399/110; 399/124; 399/298

(58) Field of Search ..... 399/299, 298, 399/107, 110, 401, 364, 124, 21; 271/902

(56) References Cited

U.S. PATENT DOCUMENTS

| | | | | | |
|---|---|---|---|---|---|
| 4,745,439 | A | * | 5/1988 | Hanada et al. | 399/124 |
| 4,835,567 | A | * | 5/1989 | Ogata | 399/124 |
| 4,887,101 | A | | 12/1989 | Hirose et al. | 346/134 |
| 5,233,401 | A | * | 8/1993 | Sasaki et al. | 399/364 |
| 5,236,187 | A | | 8/1993 | Mizutani | 271/117 |
| 5,280,331 | A | * | 1/1994 | Namiki | 399/124 |
| 5,797,068 | A | * | 8/1998 | Otsuki et al. | 399/110 |
| 6,011,936 | A | * | 1/2000 | Kaneko | 399/21 |
| 6,145,828 | A | * | 11/2000 | Arai | 399/124 X |
| 6,389,260 | B1 | * | 5/2002 | Kataoka et al. | 399/298 |
| 2001/0012460 | A1 | * | 8/2001 | Sato et al. | 399/176 |
| 2001/0055499 | A1 | * | 12/2001 | Sato | 399/298 X |
| 2002/0054777 | A1 | * | 5/2002 | Itoh et al. | 399/401 |

FOREIGN PATENT DOCUMENTS

| | | | |
|---|---|---|---|
| EP | 1 014 208 A2 | | 6/2000 |
| JP | 04-028677 | | 1/1992 |
| JP | 04-138466 | | 5/1992 |
| JP | 07-199590 | | 8/1995 |
| JP | 08-076542 | | 3/1996 |
| JP | 8-166734 | | 6/1996 |
| JP | 08-328451 | | 12/1996 |
| JP | 10-072174 | * | 3/1998 |
| JP | 11-095520 | | 4/1999 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

The color image formation apparatus of the invention can include an image formation unit that is placed diagonally in relation to the vertical direction, a largest paper-feed tray that is placed below the image formation unit and feeds paper to image formation sections of the image formation unit, and a small-size paper-feed tray, placed below the image formation unit and above the largest paper-feed tray, which feeds paper to the image formation sections of the image formation unit.

20 Claims, 13 Drawing Sheets

APPARATUSES FOR COLOR IMAGE FORMATION, TANDEM COLOR IMAGE FORMATION AND IMAGE FORMATION

This application is a Division of application Ser. No. 09/962,899, now U.S. Pat. No. 6,567,643 filed Sep. 26, 2001, which is incorporated herein by reference.

FIELD OF THE INVENTION

The present invention relates to a color image formation apparatus, a tandem color image formation apparatus and an image formation apparatus, which use multiple latent image substrates. For example, the invention relates to image formation apparatuses such as copiers, printers, facsimile machines, and the like.

BACKGROUND OF THE INVENTION

Conventionally, a color image formation apparatus, wherein toner images formed on multiple photosensitive bodies are sequentially transferred onto a single sheet of transfer paper such that the images are superimposed to obtain a color image, is known as disclosed for example in Japanese Patent No. 2677566.

In the conventional color image formation apparatus, a so-called tandem image formation unit, wherein image formation sections, each comprising a photosensitive body for a color, are arranged in conveyance direction of the transfer paper, and a transfer unit comprising a transfer belt, are both placed horizontally. Further, a paper-feed tray is placed on a side of the image formation unit and the transfer unit.

According to such a conventional color image formation apparatus, color toner images formed on multiple photosensitive bodies are superimposed on the transfer paper to obtain the color image.

In the above conventional tandem color image formation apparatus, since the image formation unit is placed horizontally and the paper-feed tray is placed on the side of the image formation unit, lateral breadth of the apparatus becomes wide and it has been desired to reduce more space required for installation of the apparatus.

There is, for example, an image formation apparatus disclosed in Japanese Laid Open Patent No. 11-95520, which is downsized by reducing the breadth of the apparatus. In the apparatus, multiple laser scanning units are stacked partially overlapping each other, and multiple image formation devices plus a transfer unit arranged opposite to the devices are placed diagonally. This structure enables reduction in breadth of the image formation section and breadth of the whole apparatus.

Recently, needs for image formation on both sides of paper have increased, and more apparatuses are equipped with a mechanism for reversing the sides of the paper. The apparatus disclosed in Japanese Laid Open Patent No. 11-95520 is also provided with a switchback conveyance path for reversing the paper, and re-feeds the paper to the image formation section after leading the paper passed through a fixing device to this switchback conveyance path and reversing the sides of the paper.

There are also image formation apparatuses such as copiers, printers, facsimile machines, and the like, wherein: a recording material is held on a belt that is rotary-driven; and a transfer conveyance belt device for transferring the developed image, formed on an image substrate, onto the recording material while conveying the recording material in accordance with rotation of the image substrate. Generally, these apparatuses have a structure wherein the recording material is fed to the image substrate and a transfer section that is in the transfer conveyance belt device, with a timing adjusted with a resistant unit such as resistant rollers or the like.

An image formation apparatus is also disclosed, wherein a transfer conveyance belt device is placed diagonally (in such a way that heights of an inlet and an outlet for a recording material are different) and a paper conveyance path is shortened, to reduce time needed for printing.

In this image formation apparatus, there are several ways of paper-ejection such as a paper-ejection tray provided on top face of the apparatus or on a side of the apparatus. For printers, for example, paper-ejection trays are provided on top of the apparatus to enable page collation.

On the other hand, many copiers eject paper to a side of the copier main body since they are equipped with a scanner, and/or an ADF (automatic document feeder) on top of the copier. When a duplex mechanism is provided in printers or copiers, the fixed paper is conveyed downward in some cases. As explained above, ways of conveying the fixed paper vary with the structure of the image formation apparatus.

In the conventional tandem color image formation apparatuses, although it is attempted to reduce volume of the apparatus by placing the image formation unit diagonally, the breadth is still large as the paper-feed tray is placed on the side, and further reduction in space required for the installation has been demanded.

In the apparatus disclosed in Japanese Patent Application Laid Open No. 11-95520, since the switchback conveyance path has a structure wherein the paper is conveyed in two horizontal directions to reverse the sides of the paper, breadth of the paper reversal section is wide. In other words, in the apparatus, a section that practically reverses the paper is the switchback conveyance path, and the paper is reversed in the section that is less than half the breadth of the whole apparatus. Therefore, if faces, of a large paper such as an A3 paper in a lengthwise direction, are to be reversed, the breadth of the apparatus must be wide. If the breadth of the apparatus is reduced too much, reversal of large paper becomes impossible.

In such conventional image formation apparatuses downsized by reducing the breadth of the apparatus, the reduction in the breadth of the image formation section is not turned to advantage, as the breadth of the paper reversal mechanism section has to be widened, even if the image formation device and the transfer unit are placed diagonally to reduce the breadth of the image formation section.

In the conventional image formation apparatuses having a structure wherein the transfer conveyance belt device is placed diagonally, when the fixing device is placed diagonally in accordance with the paper conveyance direction directed by the transfer conveyance belt device, the paper ejection direction of the fixing device becomes diagonal, and creates a problem that it can be both advantageous and disadvantageous in terms of compatibility of the apparatus to the above-described different directions of paper conveyance.

For example, when the paper is to be conveyed to the paper-ejection tray on top of the apparatus, ejection of the paper diagonally upward from the fixing device that is placed diagonally is preferable, in terms of paper conveyance. However, if the paper is to be fed to the duplex mechanism that is placed below the fixing device, the conveyance direction of the paper ejected diagonally upward from the fixing device that is placed diagonally has to be altered greatly, and this will increase length of the conveyance path and thus the space required for the apparatus.

Thus, even when the transfer conveyance belt device is to be placed diagonally, the apparatus may be made to correspond to various conveyance directions by providing the fixing device horizontally. For example, in an apparatus disclosed in Japanese Laid Open Patent No. 8-87151, although the transfer conveyance belt device is placed diagonally (in an embodiment of the apparatus, diagonally from the top to the bottom), the fixing device is placed horizontally. However, in the embodiment, the conveyance direction of the paper fed out from the transfer conveyance belt device is to be changed with a guide plate at an entrance of the fixing device. According to such a structure, the paper is bent as the paper, holding a toner image to be fixed, is slidingly scraped on the guide plate when the conveyance direction of the paper is altered. As a result, the unfixed toner image on the paper may be damaged.

According to the structure wherein the recording material is fed out to the image substrate and the transfer section of the transfer conveyance belt device with the timing adjusted by the above-described conventional resistant unit such as resistant rollers, the conveyance of the recording material may be affected during a process of delivering the recording material to the transfer conveyance belt device from the resistant rollers. For example, if the recording material is firm, at an instant when a trailing end of the recording material comes out of the resistant rollers, a slight vibration is caused, and as a result a problem occurs wherein a variation in the image position against the recording material is caused. In the color image formation apparatus wherein multiple images differently colored from each other are sequentially superimposed onto a sheet of paper, this problem leads to a big problem that the image obtained becomes out of color registration.

SUMMARY OF THE INVENTION

It is a first object of the present invention to provide a color image formation apparatus and a tandem color image formation apparatus wherein reduction of space required for the apparatus can be achieved.

Further, it is a second object of the present invention to provide a color image formation apparatus and a tandem color image formation apparatus wherein reduction of apparatus volume can be achieved with reduction in the breadth of the apparatus even when the apparatus is equipped with a paper reversal mechanism.

Further, it is a third object of the present invention to provide an image formation apparatus: wherein the problems associated with the image formation apparatus comprising the transfer conveyance belt device that is placed diagonally are solved; which is compatible with the various ways of paper conveyance following the fixing process; and wherein the unfixed toner image on the paper is not damaged before the fixing process.

Further, it is a fourth object of the present invention to provide an image formation apparatus wherein the above-explained problems associated with the conventional image formation apparatus are solved, and the adverse effects on the recording material that is conveyed on the transfer conveyance belt device are prevented.

The invention relates to a color image formation apparatus for forming a color image comprising an image formation unit, which is placed diagonally in relation to a vertical direction, a largest paper-feed tray which is placed below the image formation unit and feeds paper toward image formation sections of the image formation unit, a small-size paper-feed tray which is placed below the image formation unit and above the largest paper-feed tray, and feeds paper toward the image formation sections of the image formation unit.

Further, the invention is a tandem color image formation apparatus comprising an image formation unit wherein three or more colors of respectively independent image formation sections are placed parallel along the paper conveyance direction and diagonally in relation to a vertical direction, a largest paper-feed tray which is placed below the image formation unit and feeds paper toward the image formation sections of the image formation unit, and a small-size paper-feed tray which is placed below the image formation unit and above the largest paper-feed tray, and feeds paper toward the image formation sections of the image formation unit.

Further, the invention relates to a color image formation apparatus, which is capable of duplex printing, comprising an image formation unit which is placed diagonally in relation to a vertical direction, a paper-feed section which is placed below the image formation unit and feeds paper toward image formation sections of the image formation unit, a transfer unit which is placed parallel and opposite to the image formation unit, a duplex reversal unit which is placed on a side of the apparatus, and reverses sides of transfer paper, along the vertical direction, after the paper is passed through the transfer unit, and a duplex conveyance unit which is placed below the transfer unit and re-feeds the reversed transfer paper toward the image formation sections.

Further, the invention is a tandem color image formation apparatus comprising an image formation unit wherein three or more colors of respectively independent image formation sections are placed parallel along paper conveyance direction and diagonally in relation to a vertical direction, a paper-feed section which is placed below the image formation unit and feeds paper toward the image formation sections of the image formation unit, a transfer unit which is placed parallel and opposite to the image formation unit, a duplex reversal unit which is placed on a side of the apparatus, and reverses sides of transfer paper, along the vertical direction, after the paper is passed through the transfer unit, a duplex conveyance unit which is placed below the transfer unit and re-feeds the reversed transfer paper toward the image formation sections.

Further, the invention provides an image formation apparatus comprising an image substrate, a transfer conveyance belt device that is placed opposite to the image substrate, and a heat fixing device, wherein the transfer conveyance belt device is placed diagonally in such a manner that height of a recording material inlet is different from that of a recording material outlet, and wherein conveyance direction of the recording material conveyed by the transfer conveyance belt device is altered at a fixing nip of the heat fixing device before the recording material is ejected from the fixing device.

Further, the invention relates to an image formation apparatus comprising an image substrate, a transfer conveyance belt device which is placed opposite to the image substrate, a resistant unit which conveys a recording material to the transfer conveyance belt device with a timing adjusted in accordance with a position of an image on the image substrate, wherein multiple image substrates are placed parallel and opposite to the transfer conveyance belt device and formation of a color image is possible by transferring the images formed on respective image substrates onto the recording material that is conveyed by the transfer conveyance belt device such that the images are superimposed, and the transfer conveyance belt device is configured in such a manner that its posture can be controlled, and in a color mode, the posture of the transfer conveyance belt device is controlled to make the conveyance direction of the recording material directed by the transfer conveyance belt device approximately equal to that directed by the resistant unit.

Other objects and features of this invention will become apparent from the following description with reference to the accompanying drawings.

DESCRIPTION OF THE PREFERRED EMBODIMENTS

Embodiments of a color image formation apparatus, a tandem color image formation apparatus, and an image formation apparatus, according to the present invention, will be explained in detail while referring to accompanying drawings, in order from first to fourth embodiments.

Figure 1:
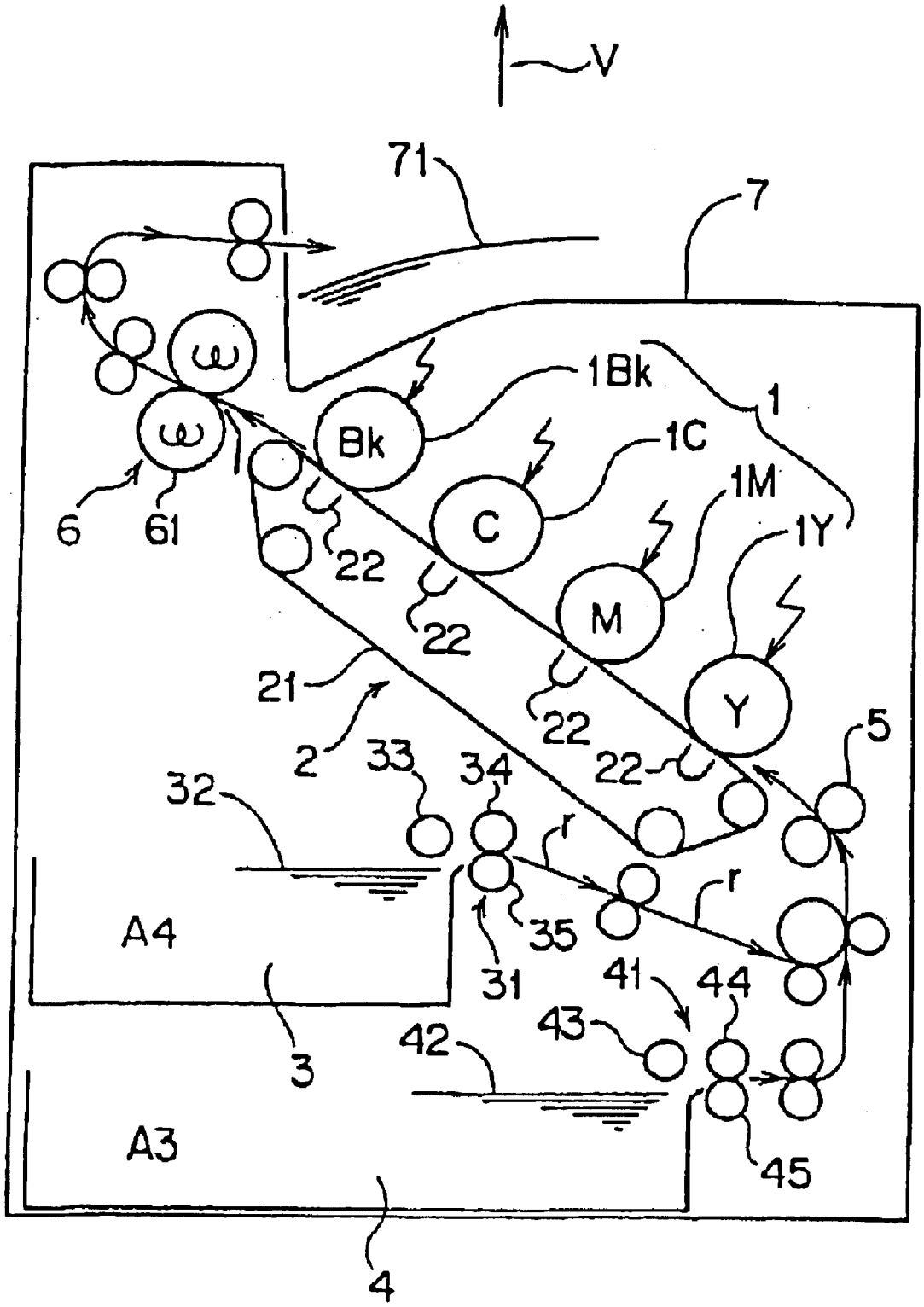
FIG. 1 schematically shows the whole structure of a color image formation apparatus according to a first embodiment of the present invention.

FIG. 1 schematically shows the whole structure of a color image formation apparatus according to a first embodiment of the present invention.

As shown in FIG. 1, this color image formation apparatus comprises: an image formation unit 1 that is placed diagonally in relation to a vertical direction V; a fixing unit 6 that is placed downstream (upper end of the image formation unit 1); a transfer unit 2 that is placed below and parallel to the image formation unit 1; an A4-paper-feed tray 3 as a small-size paper-feed tray, which is placed below the image formation unit 1 and feeds A4 paper 32 toward image formation sections 1Bk, 1C, 1M, and 1Y in the image formation unit 1; an A3-paper-feed tray 4 as a largest paper-feed tray, which is placed below the A4-paper-feed tray 3, and feeds A3 paper 42 toward image formation sections 1Bk, 1C, 1M, and 1Y in the image formation unit 1; and a paper-ejection tray 7 for face-down paper-ejection, which is placed above the image formation unit 1 and downstream of the fixing unit 6.

The differently colored image formation sections 1Bk, 1C, 1M, and 1Y in the image formation unit 1, each comprises an exposure device having a color laser beam emitting device, a photosensitive drum as a latent image substrate, a charger, a development device, and the like, as in the conventional examples already explained, although not shown in the figure.

The image formation unit 1 is placed in such a way that the image formation sections 1Bk, 1C, 1M and 1Y are arranged in a direction (transfer paper conveyance direction) that is diagonal to the vertical direction V. A diagonal angle of the image formation unit 1, in relation to the vertical direction V is preferably an angle wherein a horizontal (lateral in the figure) width of the diagonally placed image formation unit 1 is approximately equal to a horizontal (lateral in the figure) width of the A3-paper-feed tray 4, for reduction of apparatus volume.

The transfer unit 2 comprises a transfer charger 22 for transferring a developed image onto transfer paper and a transfer belt 21 for conveying the transfer paper.

The fixing unit 6 comprises a fixing roller 61, a fixing section for fixing the developed image transferred onto the transfer paper. In the figure, the fixing roller 61 is used, however, a fixing belt may be used instead.

The A4-paper-feed tray 3 (containing A4 paper sideways in the first embodiment) is placed below the transfer unit 2, and configured in such a manner that sheets of paper are ejected sheet by sheet out of the tray from a paper-feed section 31 comprising a pickup roller 33, a paper-feed roller 34, and a separation roller 35. A conveyance path r of the sheet of paper ejected from the paper-feed section 31 of the A4-paper-feed tray 3 is turned downward first to be conveyed to resistant rollers 5. Therefore, height of the whole apparatus can be reduced.

Similarly, the A3-paper-feed tray 4 (containing A3 paper lengthways in the first embodiment) is placed below the A4-paper-feed tray 3, and configured in such a manner that sheets of paper are ejected out of the tray sheet by sheet from a paper-feed section 41 comprising a pickup roller 43, a paper-feed roller 44, and a separation roller 45. The A3-paper-feed tray 4, in contrast to the A4-paper-feed tray 3, is configured in such a way that the conveyance path of the sheet ejected from the paper-feed section 41 of the A3-paper-feed tray 4 is turned approximately horizontally or upward, to be directed and conveyed to the resistant rollers 5.

Since the paper-feed sections 41 and 31 of the A3-paper-feed tray 4 and the A4-paper feed tray 3 are in positions offset from each other, particularly vertical height of the apparatus can be reduced further. Moreover, distance between the paper-feed section 41 of the A3-paper-feed tray 4 and the resistant rollers 5 can be shortened enabling an optimization of conveyance structure to shorten time required for fast printing. In addition, the length of each conveyance path from each paper-feed section of each paper-feed tray can be set such that they are the same between the A3-paper-feed tray 4 and the A4-paper-feed tray 3.

The paper-ejection tray 7 is placed downstream of the fixing unit 6 and above the image formation unit 1, and facedown paper-ejection (shown by a reference numeral 71 in the figure) wherein a recorded side of the transfer paper is to face downward, is carried out.

The color image formation apparatus operates as explained below.

In the image formation section 1C, the photosensitive body charged uniformly by the charger is exposed with the laser emitting device to form a latent image of cyan light image, and the image is developed with the development device to form a developed image. Similarly, in the image formation sections 1Bk, 1M, and 1Y, latent images of black, magenta, and yellow light images are formed respectively, and each latent image is developed with each development device to form a developed image.

Leading ends of sheets of transfer paper that are fed from the paper-feed tray 3 or 4 with the paper-feed roller 34 or 44, sheet by sheet, are aligned in a correct position and conveyed to the transfer belt 21, which is a transfer paper conveyance unit, with a certain timing adjusted by the resistant rollers 5. That is, the resistant rollers 5 stops the transfer paper temporarily, before conveying the paper to the image formation unit 1 in accordance with the timing. The transfer paper conveyed by the transfer belt 21 is fed sequentially to the image formation units 1Bk, 1C, 1M, and 1Y wherein a developed image each is formed and the developed image is transferred under the influence of the transfer charger 22. The transfer paper with a full-color developed image transferred onto it is fixed by the fixing roller 61, and fed to the paper-ejection tray 7 or a duplex reversal unit not shown in the diagram.

In the first embodiment, the largest paper-feed tray has a size that contains the A3 paper, however, this is only an example. The tray may have a size that contains paper larger or smaller than the A3 paper. Moreover, the small-size paper-feed tray has a size that contains the A4-paper, however, this is only an example. The tray may have a size that contains paper larger than the A4 paper and smaller than the paper contained in the largest paper-feed tray, or a size that contains paper smaller than the A4 paper.

When paper is to be contained in two rows aligned laterally, a total area of the paper contained in the largest paper-feed tray is larger than that in the small-size paper-feed tray. Although a number of the small-size paper-feed trays is one in the first embodiment, there may be plurality of the trays above and below the tray. In this case, if there are to be a plurality of the small-size paper-feed trays in different sizes, the trays are stacked in order of sizes such that the upper trays are smaller.

The present invention should not be limited to the first embodiment. That is, it is susceptible of various changes and modifications without departing from the essentialities of the present invention.

Figure 2:
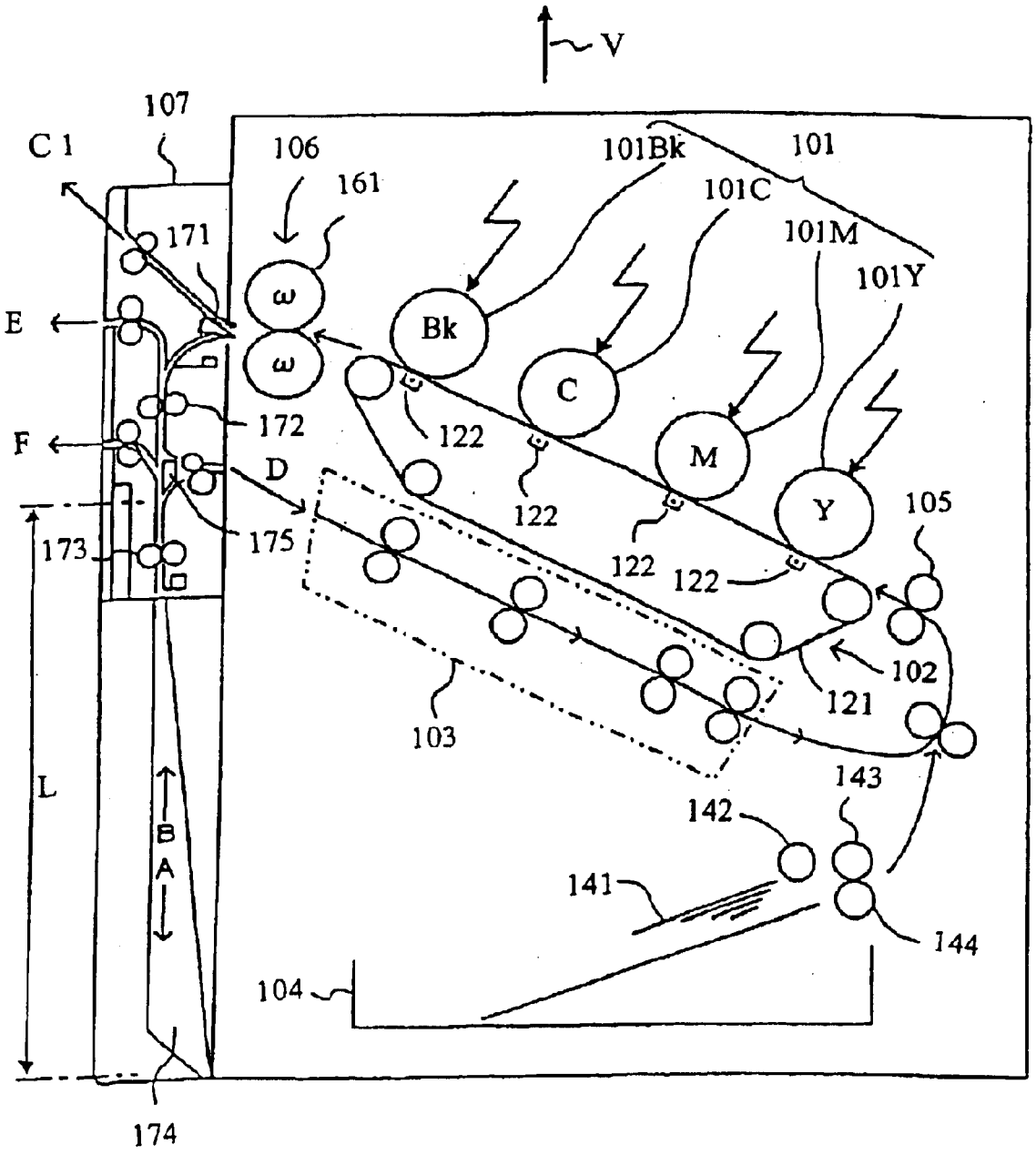
FIG. 2 schematically shows the whole structure of a color image formation apparatus according to a second embodiment of the present invention.

FIG. 2 shows a schematic diagram representing the whole structure of a color image formation apparatus according to a second embodiment of the present invention.

As shown in FIG. 2, this color image formation apparatus comprises an image formation unit 101 placed diagonally in relation to a vertical direction V; a fixing unit 106 placed downstream (upper end side of the image formation unit 101) of the image formation unit 101; a paper-feed tray 104, a paper-feed section which is placed below the image formation unit 101 and feeds paper toward image formation sections 101Bk, 101C, 101M, and 101Y in the image formation unit 101; a transfer unit 102 placed diagonally, and against the image formation unit 101; a duplex reversal unit 107 placed on a side of the apparatus and downstream of the image fixing unit 106; and a duplex conveyance unit 103 which is placed below the transfer unit 102, and re-feeds in combination with the duplex reversal unit 107, transfer paper with its sides reversed, toward the image formation unit 101.

The different colors of the image formation sections 101Bk, 101C, 101M, and 101Y in the image formation unit 101, each comprises an exposure device having a color laser beam emitting device, a drum photosensitive body as a latent image substrate, a charger, a development device and the like, as already explained in the conventional examples, although not shown in the diagram.

The image formation unit 101 is placed in such a way that the image formation sections 101Bk, 101C, 101M, and 101Y are arranged in a direction (transfer paper conveyance direction) that is diagonal in relation to the vertical direction V. A diagonal angle of the image formation unit 101, in relation to the vertical direction V is preferably an angle wherein a horizontal (lateral in the figure) width of the diagonally placed image formation unit 101 is approximately equal to a horizontal (lateral in the figure) width of the paper-feed tray 104, for reduction of apparatus volume.

The transfer unit 102 comprises a transfer charger 122 for transferring a developed image onto transfer paper and a transfer belt 121 for conveying the transfer paper.

The fixing unit 106 comprises a fixing roller 161 for fixing the developed image transferred onto the transfer paper. In the figure, the fixing roller 161 is used, however, a fixing belt may be used instead.

The duplex reversal unit 107 has functions for ejecting (in a direction indicated by an arrow C) the transfer paper with the developed image fixed on one side, faceup, and for conveying the paper to a duplex conveyance unit 103 (in a direction indicated by an arrow D) to form a developed image on the other side of the paper.

The duplex conveyance unit 103 re-feeds the paper to the image formation unit 101 in corporation with the duplex reversal unit 107, with the sides of the transfer paper that has the developed image fixed on one side reversed.

The paper-feed tray 104 is placed below the duplex transfer unit 103, and configured in such a manner that sheets of paper 141 are ejected sheet by sheet out of the tray by a pickup roller 142, a paper-feed roller 143, and a separation roller 144.

Now, the duplex reversal unit 107 will be explained in detail below.

As shown in the figure, the duplex reversal unit 107 comprises a switch nail 171 on a side of the fixing unit 106. When the switch nail 171 is in a position shown by a solid line, the transfer paper is lead to a conveyance path extending diagonally upward, and ejected out to a paper-ejection tray not shown in the diagram, in a direction indicated by an arrow C.

When the switch nail 171 is switched into a position shown by a virtual line, the conveyance direction of the transfer paper is changed downward, and rotations of reversal rollers 172 and 173 are reversed. As the transfer paper is conveyed in a direction of an arrow B, sides of the transfer paper are reversed.

A switch nail 175 that can come into three positions is provided between the reversal roller pairs 172 and 173, and the nail directs the reversed transfer paper to be conveyed toward the duplex conveyance unit 103 (in a direction indicated by an arrow D), or toward paper-ejection tray not shown in the diagram facedown (in directions shown by arrows E and F). Subsequent processing devices such as sorters or the like can be installed on a side (left side in the figure) of the duplex reversal unit 107. In this case, the sides-reversed transfer paper is conveyed in the direction indicated by the arrow E or F, to be received by the subsequent processing devices not shown in the diagram. The devices then performs page collation, stapling, and the like.

In the duplex reversal unit 107, the sides of the transfer paper are reversed along vertical directions indicated by arrows A and B. Length that can be used for this paper reversal, is a distance L from a lower section of the switch nail 175 to a lower end of the transfer section 174, securing enough reversal length using the vertical height at the side of the apparatus. Therefore, a large transfer paper such as an A3 paper in a longitudinal direction (420 mm) can be reversed easily.

Since in the second embodiment, in the duplex reversal unit 107 placed at the side of the apparatus, the sides of the transfer paper are reversed along the directions indicated by the arrows A and B, breadth of the paper reversal section does not have to be enlarged, and width of the whole apparatus thus will not become wide. In other words, effect of reducing breadth of the whole image formation arrangement by arranging the image formation unit 101 and the transfer unit 102 diagonally, will not be countervailed by the paper reversal section, and the width of the whole apparatus will not become large even when the apparatus is provided with the paper reversal mechanism.

In the second embodiment, as a result of placing the duplex reversal unit 107 on the side of the apparatus and configuring the unit in a manner that the sides of the transfer paper are reversed along the vertical direction, leading end of the reversed transfer paper (trailing end of the paper before reversal) is approximately at a position of the switch nail 175, which is high (and not at the bottom of the apparatus) Therefore, ejection of the reversed transfer paper and delivery of the transfer paper to the subsequent processing devices if the subsequent processing devices are installed to the duplex reversal unit 107, can be easily and smoothly done, without complicating the paper conveyance paths.

If the sides are reversed along a horizontal direction at a lower position near the bottom of the apparatus, since normally, the paper-ejection tray is provided on the top of the apparatus and paper inlets of the subsequent processing devices are provided at the top, the reversed paper must be conveyed to a higher position from a lower position, increasing lengths of and complicating the paper conveyance paths.

Figure 3:
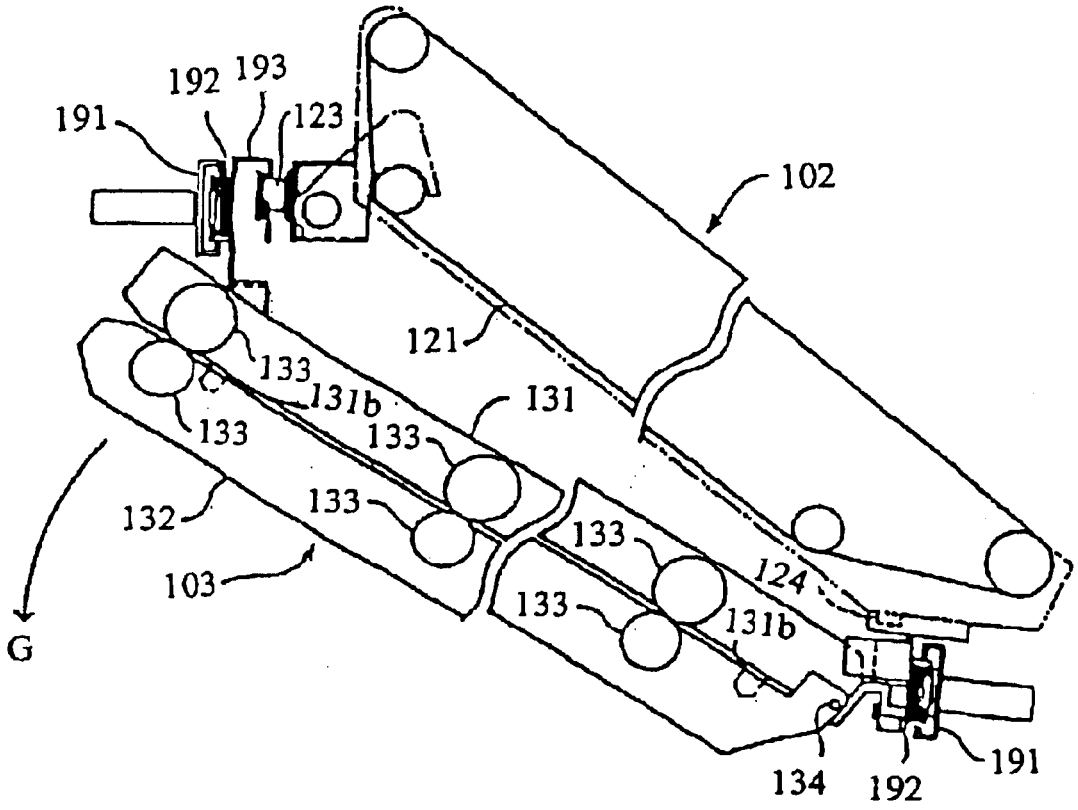
FIG. 3 shows a state of attachment between a transfer unit and a duplex conveyance unit according to the second embodiment.

FIG. 3 shows a state of attachment between the transfer unit 102 and the duplex conveyance unit 103.

As shown in FIG. 3, the duplex conveyance unit 103 comprises; an upper guide 131; conveyance roller 133 attached to the upper guide 131; a lower guide 132 which is attached to the upper guide rotatably via an axis 134 that is on one end of the upper guide 131; conveyance rollers 133 which are attached to the lower guide 132 against the conveyance rollers of the upper guide 131; and boss sections 131*b* which connect the upper and lower guides such that the guides can be opened and closed.

The transfer unit 102 is attached to a movable slide rail 192 via a roller 123 that is attached to the transfer unit 102 and an intermediate member 193 attached to the roller 123. The movable slide rail 192 is slidably supported by a fixed guide rail 191 that is attached to a main body, and the slide rail 192 can be withdrawn in a back and forth direction of the apparatus.

Figure 4:
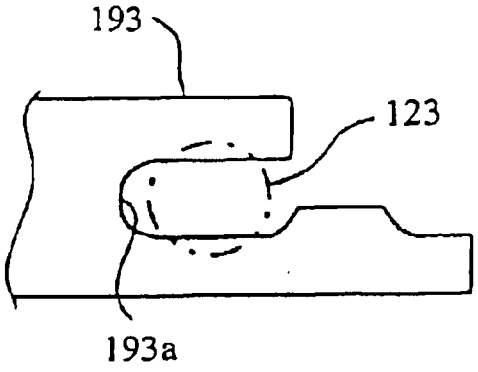
FIG. 4 shows elements of detachable structure of the transfer unit according to the second embodiment.

As shown in FIG. 4, since in the transfer unit 102, the roller 123 of the transfer unit 102 is inserted in a groove 193*a* that is formed inside the intermediate member 193 fixed onto the movable slide rail 192, the transfer unit 102 can be withdrawn out in front and lifted upward to be removed. At an upper end of the transfer unit 102, as shown in FIG. 4, the roller 123 attached to the upper end is supported inside the groove 193*a* of the intermediate member 193 fixed on the movable slide rail 192, and at the other end, a protrusion 124 is removably inserted through a hole on the movable slide rail 192 side. As a result, the transfer unit 102 can be with drawn out in front and lifted up, to be removed.

The upper guide 131 of the duplex conveyance unit is attached to the movable slide rail 192, and the movable slide rail 192 is slidably supported by the fixed guide rail 191 that is attached to the main body and can be withdrawn in a back and forth direction of the apparatus.

The color image formation apparatus operates as explained below.

In the image formation section C, the photosensitive body charged uniformly by the charger is exposed with the laser-emitting device to form a latent image of cyan light image, and the image is developed with the development device to form a developed image. Similarly, in the image formation sections 101Bk, 101M, and 101Y, latent images of black, magenta, and yellow light images are formed respectively, and each latent image is developed with each development device to form a developed image.

Leading ends of sheets of transfer paper that are fed from the paper-feed tray 104 with the paper-feed roller 143, sheet by sheet, are aligned in a correct position and conveyed to the transfer belt 121, which is a transfer paper conveyance unit, with a certain timing, by the resistant rollers 105. That is, the resistant rollers 105 stop the transfer paper 141 temporarily, before conveying the paper to the image formation unit 101 in accordance with the timing. The transfer paper conveyed by the transfer belt 121 is fed sequentially to the image formation units, 101Bk, 101C, 101M, and 101Y, wherein a developed image each is formed and the developed image is transferred under the influence of the transfer charger 122. The transfer paper 141 with a full-color developed image transferred onto it undergoes fixing by the fixing unit 106, and fed to the duplex reversal unit 107. The transfer paper 141 fed to the duplex reversal unit 107 is ejected faceup (in the direction indicated by the arrow C1) if an image is to be formed on one side only, or fed to the duplex conveyance unit 103 if images are to be formed on both sides.

The transfer paper 141 with the image formed on one side, which is fed to the duplex conveyance unit 103, is re-fed to the image formation unit 101 to have an image formed on the other side.

If jamming of the transfer paper 141 is caused during such formation of color images, jammed paper must be removed.

For example, if there is jamming caused between the image formation unit 101 and the transfer unit 102, the transfer unit 102 can be withdrawn out in front of the apparatus to expose the top surface of the transfer unit 102 outside the apparatus and remove the jammed paper easily.

For maintenance of the transfer unit 102, the transfer unit 102 can be withdrawn first and then lifted up along the groove 193*a* of the intermediate member 193, to be detached.

If jamming is caused between the upper guide 131 and the lower guide 132 of the duplex conveyance unit 103, the duplex conveyance unit 103 can be withdrawn out in front of the apparatus, opened by withdrawing the lower guide 132 out from the boss section 131*b* of the upper guide 131 and rotating around the axis 134 as shown by an arrow G (see FIG. 3), to remove the jammed paper easily.

Since jamming can be fixed by withdrawing the duplex conveyance unit 103 out in front as explained above, working efficiency for fixing the jam is excellent. What is more, a disposal toner bottle or the like may be placed below the duplex conveyance unit 103. Processing of jam-fixing is improved since the transfer unit 102 and the duplex conveyance unit 103 are slidable and integrated with each other that they can be withdrawn at the same time.

The present invention should not be limited to the second embodiment. That is, it is susceptible of various changes and modifications without departing from the essentialities of the present invention.

Figure 5:
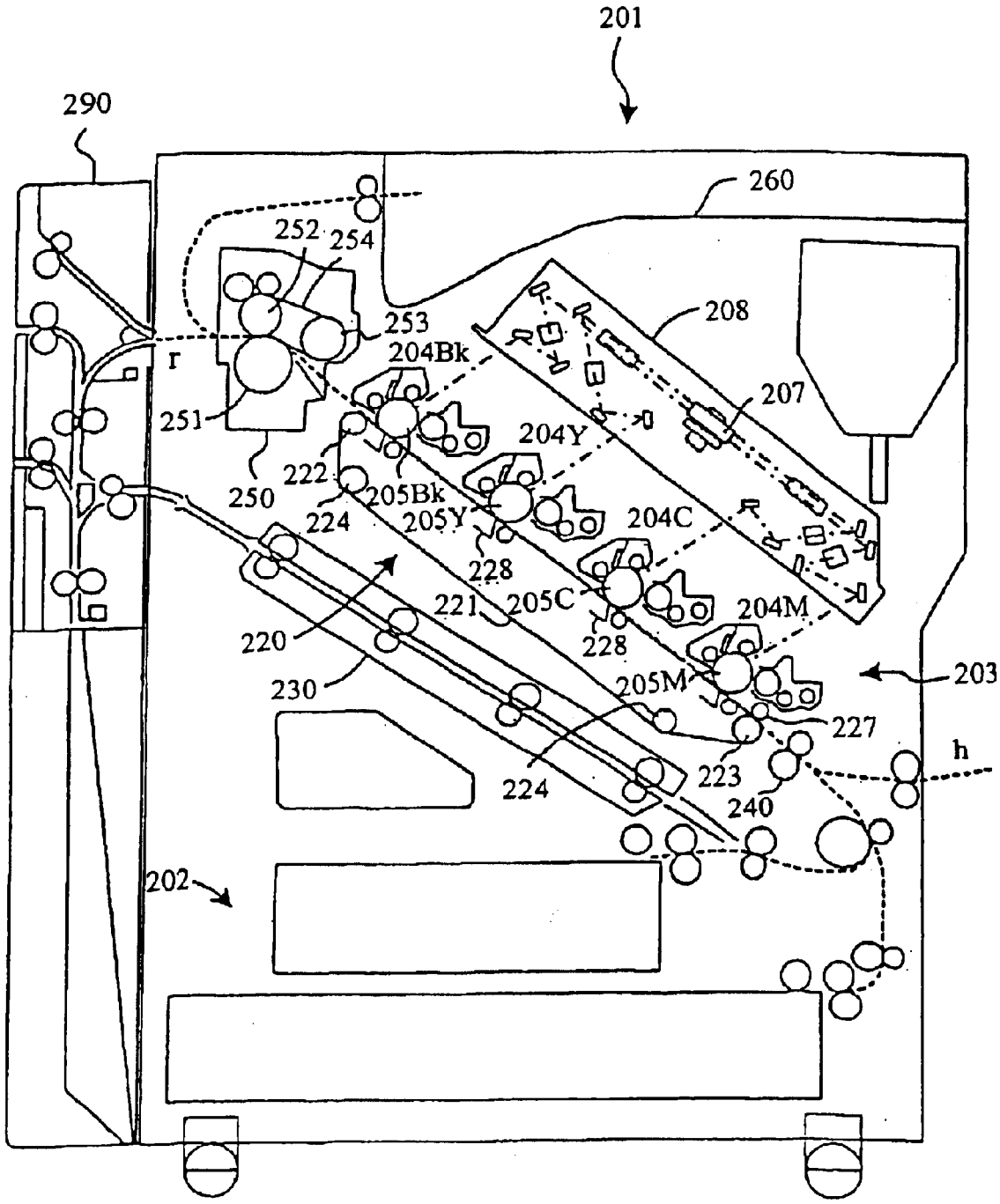
FIG. 5 is a cross section diagram showing schematic structure of a color laser printer which is one example of an image formation apparatus according to a third embodiment of the present invention.

FIG. 5 is a cross section diagram which shows a schematic structure of a color laser printer that is one example of an image formation apparatus according a third embodiment. This color laser printer 201 is provided with a paper-feed section 202 at the bottom section of the apparatus main body, and an image formation unit 203 above the paper-feed section 202. On the top face of the apparatus, a paper-ejection tray 260 is provided. Along a conveyance path of recording paper shown in the diagram with a broken line, the paper is fed from the paper-feed section 202, an image formed at the image formation unit 203 is transferred onto the paper and fixed by a fixing device 250, and the paper is ejected out to the paper-ejection tray 260. Manual paper-feed (indicated by a reference symbol: h) is possible from a side of the apparatus.

A duplex device 290 is provided on a side of the apparatus main body, which conveys the fixed paper in a direction shown by a broken line r, reverses sides of the paper via the duplex device 290, and then can also re-feeds the paper via a duplex conveyance section 230. The paper may also be ejected out to a paper-ejection tray that is at a side of the apparatus not shown in the diagram, from the duplex device 290.

In the image formation unit 203, a transfer conveyance belt device 220 is provided slanted in such a way that the paper-feed side is at the bottom and the paper-ejection side is at the top. Along the top side of this transfer conveyance belt device 220, four image formation sections for magenta (M), cyan (C), yellow (Y), and black (Bk), 204 M, 204C, 204Y, and 204 Bk, respectively in that order from the bottom, are provided side by side.

Since structures of the image formation sections, 204M, 204C, 204Y, and 204Bk, are identical, the image formation section 204C for cyan, will be explained in detail as an example.

Figure 6:
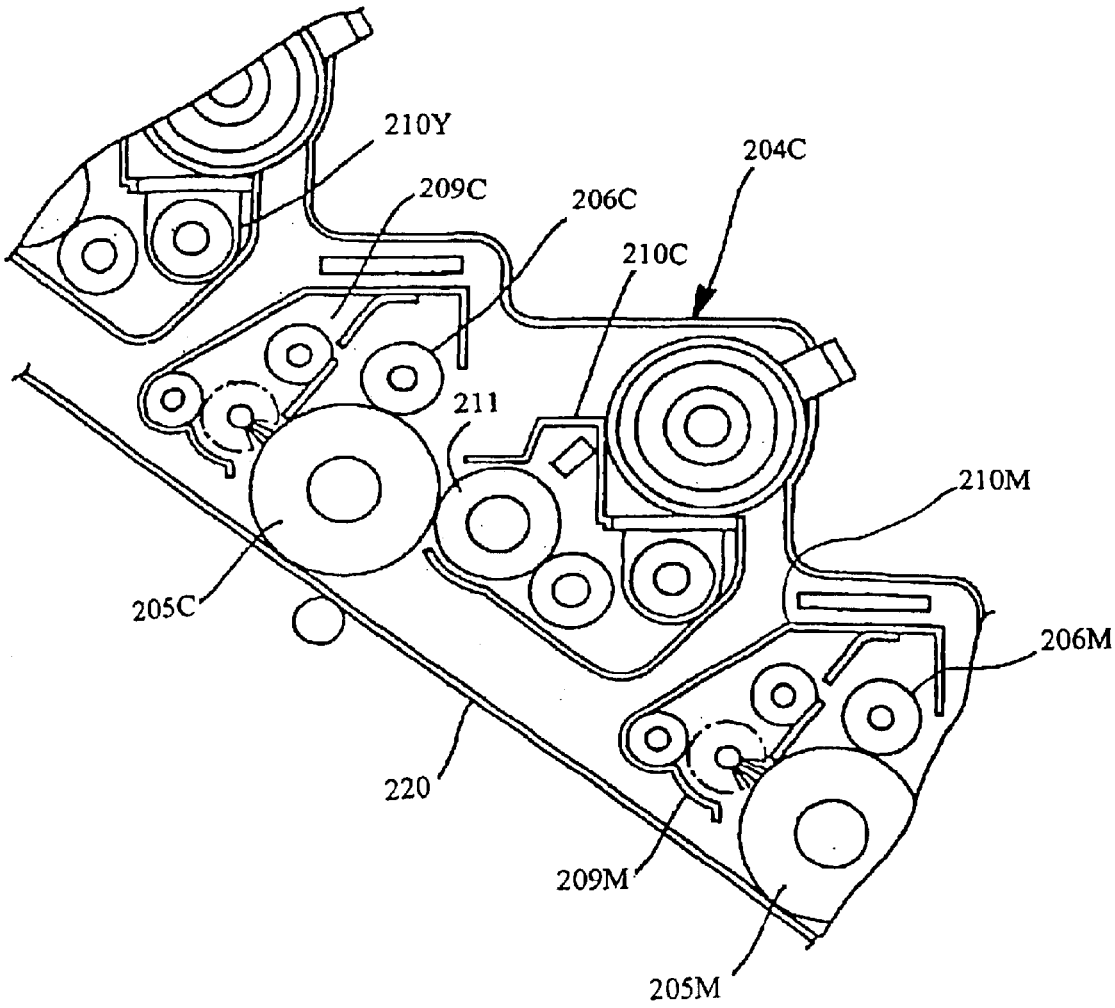
FIG. 6 shows elements on larger scale, which represent details of an image formation unit according to the third embodiment.

As shown in FIG. 5 and FIG. 6, the image formation section 204C has a photosensitive drum 205C as an image substrate, and the photo sensitive drum 205C is rotary-driven in a clockwise direction in the diagram by a drive unit not shown. Around the photosensitive drum 205C, a charge roll 206C, a development device 210C, a cleaning device 209C and the like are provided. The development device 210C is a two-component development device, comprising a toner and a carrier, which attaches the toner held on a development roll 211 onto the photosensitive drum 205C. Laser beam from a light recording device 208, is radiated through between the charge roll 206C and the development roll 211 onto the photosensitive drum 205C. In FIG. 5 and FIG. 6, to each of the reference numerals for members of the image formation section of each color, a symbol (M, C, Y, or Bk) is added after it to indicate the color.

The transfer conveyance belt 221 with an endless loop shape, extends tensioned around a drive roller 222, a driven roller 223 and two opposing rollers 224. Along the inner surface of the top side of the transfer conveyance belt 221, transfer brushes 228 are placed contacting the belt 221 in positions opposite to the respective photosensitive drums 205 of color image formation sections 204M, 204C, 204Y, and 204Bk. Transfer bias of 7 kV is applied onto these transfer brushes 228 in this example. A paper-adsorptive roller 227 is provided on top of the driven roller 223 with the belt 221 in between. The recording paper is fed onto the belt 221 from between the driven roller 227 and the adsorptive roller 227, and conveyed being adsorbed to the transfer conveyance belt 221 electrostatically by the bias voltage applied to the adsorptive roller 227.

In the transfer conveyance belt device 220, by a mechanism not shown in the diagram, in case of color printing, the belt 221 is held in contact with (the photosensitive drums of) the four colors of the image formation sections, 204M, 204C, 204Y, and 204Bk, and in case of black monochrome printing, the belt 221 is held in contact with (the photosensitive drum of) the image formation section 204Bk only.

Figure 7:
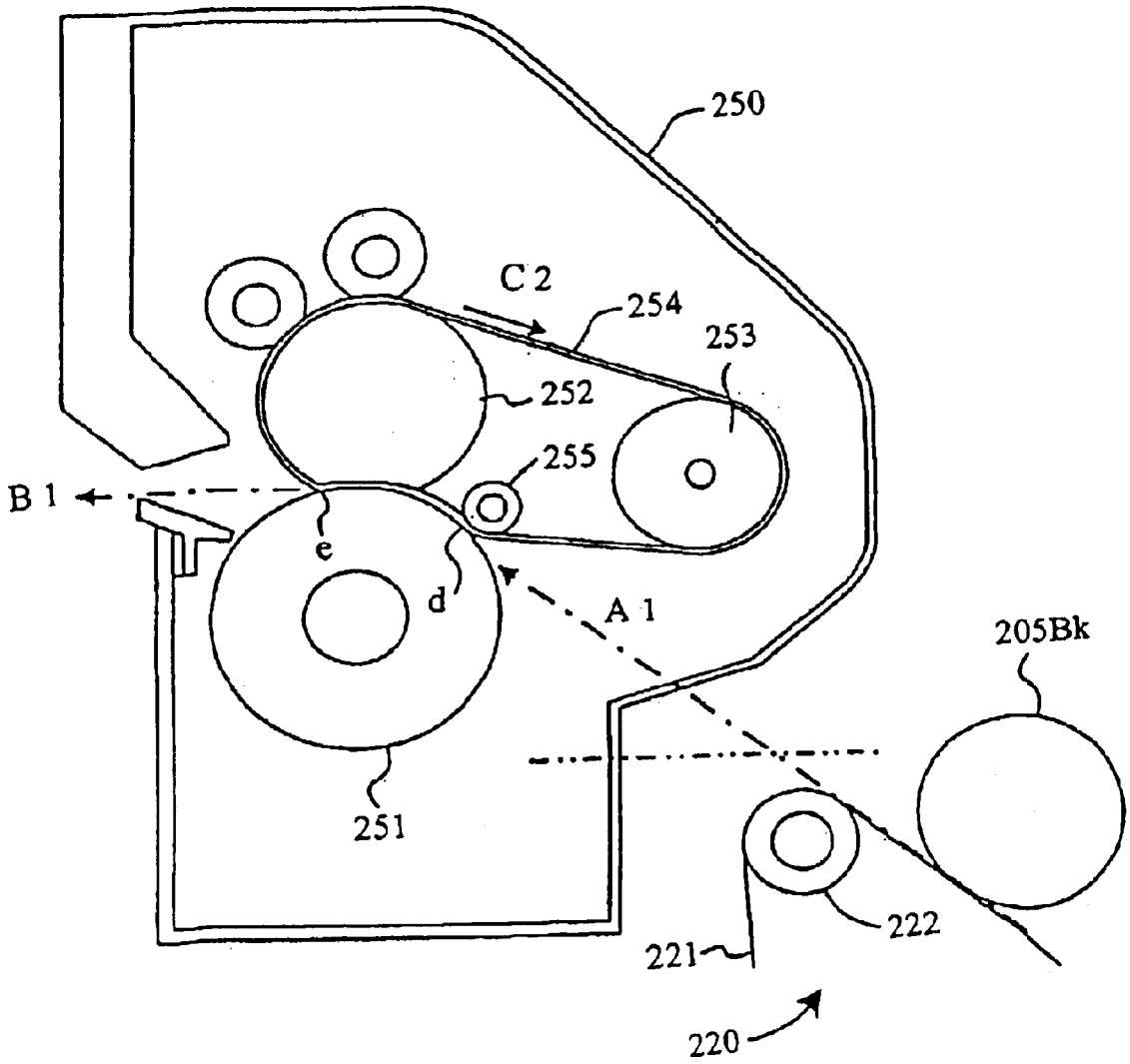
FIG. 7 is a cross section diagram showing structure of a fixing device according to the third embodiment.

FIG. 7 is a cross section diagram showing the structure of the fixing device 250.

The fixing device of this example is a belt fixing system, wherein: a fixing roller 252, composed of a comparatively soft material, for example, sponge, is pressed against a rigid pressure roller 251; and a belt 254 is wound around the fixing roller 252 and a heat roller 253 that is placed upstream of the paper conveyance direction. The fixing belt 254 rotates in a direction shown by an arrow C2. Heaters not shown in the diagram are provided inside the hear roller 253 and the pressure roller 251. In this belt fixing system, there is an advantage that time needed for warm-up is short in contrast to a roller fixing system.

Printing operations according to the third embodiment will now be explained while referring to FIG. 5 and FIG. 6.

In the image formation section 204M for magenta, surface of the photosensitive drum 205M is charged evenly to a predetermined potential with the charge roll 206M. In the light recording device 208, an LD (laser diode) not shown in the figure is driven according to image data sent from a host machine such as a personal computer or the like. The laser beam illuminates a polygon mirror 207, and reflected light is lead to the photosensitive drum 205M via a cylinder lens or the like, to form an electrostatic latent image to be developed on the photosensitive drum 205M with a magenta toner. The toner from the development device 210M is attached to this latent image, to form a visible image of magenta toner.

Paper that has been specified as a transfer material is fed from the paper-feed section 202, and the fed paper strikes against the resistant roller pair 240 provided upstream of the conveyance direction of the transfer conveyance belt device 220, first. During color printing, in the transfer conveyance belt device 220, as explained above, the transfer conveyance belt 221 is pushed up, with the belt 221 contacting (the photosensitive drums of) the four colors of image formation sections 204M, 204C, 204Y, and 204Bk. The paper is then fed onto the belt 221 in sync with the above-mentioned visible image, and reaches a transfer position opposite to the photosensitive drum 205M, as the belt conveys. In this transfer position, under the influence of the transfer brush 228 arranged on the reverse side of the transfer belt 221, the visible image of magenta toner is transferred onto the paper.

The visible image of each toner is formed on surface of each photosensitive drum 205, for every other image formation unit, 204C, 204Y, or 204Bk, as in the case of magenta color. As the paper conveyed by the transfer conveyance belt 221 reaches each transfer position, the visible image is transferred superimposing each image. In the color printer according to the third embodiment therefore, transfer and superimposing of full-color images can be done in a short period of time that is approximately equal to monochrome printing.

In case of monochrome printing, in the transfer conveyance belt device 220, as explained already, the transfer conveyance belt 221 is lowered, and the belt 221 is in contact with (the photosensitive drum of) the image formation section 204Bk only. Only in the image formation section 204Bk for black color, a visible image of black toner is formed on surface of the photosensitive drum 205Bk, and the black toner image is transferred onto the paper that is fed onto the belt 221 in sync with this black visible image.

The paper after transferring the toner image, leaves the transfer conveyance belt 221, and the image is fixed in the fixing device 250. The paper after fixing is ejected out to the paper-ejection tray 260 provided on the top face of the apparatus main body, or received by the duplex device 290 as indicated by a symbol r.

In the fixing device 250 according to the third embodiment, an auxiliary roller 255 is provided upstream in the paper conveyance direction of the fixing roller 252. The auxiliary roller 255 is provided inside the loop of the fixing belt 254 and in a position such that the auxiliary roller 255 can wrap the fixing belt 254 around a given perimetric area of the pressure roller 251. A fixing nip (region that the fixing belt 254 and the pressure roller 251 come in contact) is formed as the fixing belt 254 is wrapped around a given perimetric area of the pressure roller, under the influence of this auxiliary roller 255. Here, a position wherein the fixing belt 254 in its rotary direction first comes in contact with the perimetric surface of the fixing roller 251, is indicated by a symbol d (nip starting point), and a position wherein the fixing belt 254 leaves the perimetric surface of the pressure roller 251 is indicated by a symbol e (nip end point). The height (in a vertical direction in FIG. 7) of the nip starting point d is set such that it is lower than that of the nip end point e. As a result, the conveyance direction of the paper which has been conveyed in a direction indicated by an arrow A1 by the transfer conveyance belt device 220 and approached the fixing device 250, is altered to be conveyed in a direction indicated by an arrow B1. That is, the paper conveyance direction A1 directed by the transfer conveyance belt device 220 is altered to the direction B with the fixing nip in the fixing device 250. In other words, in the third embodiment, the paper conveyance direction directed by the transfer conveyance belt device 220 is altered at the fixing device 250 such that the paper is to be slanted toward the opposite side of the side having the image to be fixed (the non-image side in case of one-side recording, which is the lower side in this case). Further, in the third embodiment, the paper-ejection direction B1 from the fixing device 250 is set to be in an approximately horizontal direction.

By altering the paper conveyance direction at the fixing device 250, toward the non-image side in case of one-side recording, curling of the paper can be prevented. In heat fixing devices, during the fixing process, curling of the paper to the side having the toner image to be fixed, tends to occur, but in the third embodiment, the curling of the paper can be prevented by altering the paper conveyance direction toward the non-image side.

Since the paper-ejection direction from the fixing device 250 is changed from the conveyance direction A1 directed by the transfer conveyance belt device 220, to be in the approximately horizontal direction B1, it becomes possible to evenly handle various ways of paper conveyance following the fixing process. In other words, when ejecting the paper to the paper-ejection tray 260 on the top face of the apparatus, keeping the paper conveyance direction after fixing in the paper conveyance direction A1 directed by the transfer conveyance belt device 220 is preferable, while this is not preferable when feeding the paper to the duplex conveyance section 230. However, in the third embodiment, since the paper-ejection direction from the fixing device 250 is in the approximately horizontal direction B1, the paper conveyance path for conveying the paper to the duplex conveyance section 230 does not have to be extended, thereby not having to increase size of the apparatus. That is, the apparatus is almost equally compatible with these cases, the case of conveying the fixed paper to the paper-ejection tray 260, and the case of conveying the paper to the duplex conveyance section 230.

The paper conveyance paths can be made compact, not only in the case of paper conveyance to the duplex conveyance section 230 of the third embodiment, but also in a case where a paper-ejection tray is provided on a side of the printer 201 main body, and the paper is ejected outside the apparatus from the fixing device 250 straight away. When a subsequent processing devices such as a sorter, is provided instead of the duplex device 290, the paper conveyance path from the fixing device 250 to the subsequent processing device can be made compact also, without increasing the size of the apparatus.

Further, in the third embodiment, since when the paper conveyance direction directed by the transfer conveyance belt device 220 is altered at the fixing device 250, toward the opposite side of the side having the image to be fixed (non-image side in case of one-side recording), the apparatus members do not come in contact with the image side immediately after fixing. Therefore, the conveyance direction of the paper can be changed without affecting the image.

In the belt fixing-device 250 according to the third embodiment, as explained already, the fixing roller 252 is configured as a comparatively soft roller, and a pressure roller 251 including a heater inside is configured as a rigid roller. Since one of the rollers that are pressed together with the fixing belt in between (the fixing roller 252 in this example) is softer than the other roller (the pressure roller 251 in this example), the paper conveyance direction can be altered easily.

When one of the roller is softer than the other, the shape of the softer roller is changed according to the shape of the rigid roller and the paper that passes through the rollers (although the fixing belt is in between) thus moves along the perimetric surface of the rigid roller. According to the structure wherein the paper conveyance direction is changed with the fixing nip like in this example, the conveyance direction is to be changed to a direction that is in line with the perimetric surface of the rigid roller. Therefore, if the paper conveyance direction is to be changed downward (at an angle lower than the angle of the conveyance direction before the paper approaches the nip) at the fixing device, a rigid roller may be placed on the lower side and a soft roller on the upper side like in the third embodiment.

Figure 8:
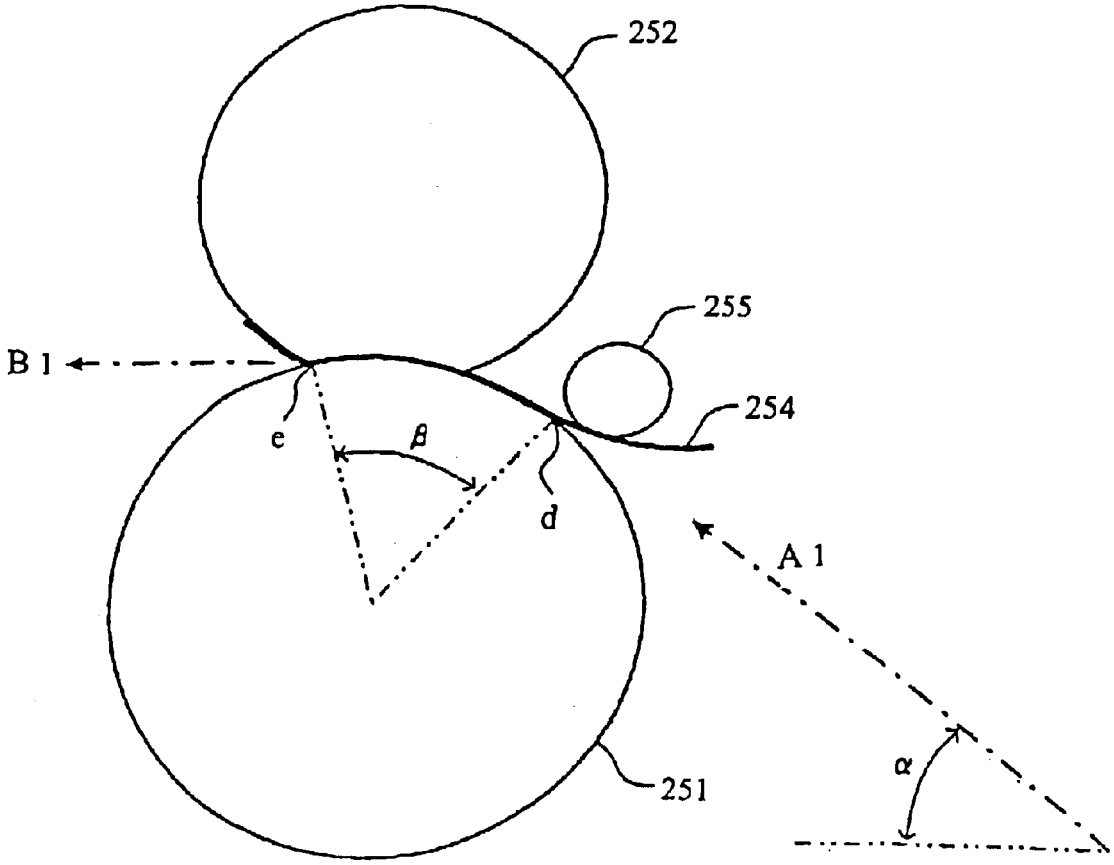
FIG. 8 shows a schematic diagram for explaining a nip of the fixing device according to the third embodiment.

As explained above, in the fixing device 250, the fixing nip is formed as the area (d to e) where the belt 254 is wrapped around the pressure roller 251. This fixing nip is shown in FIG. 8, with the angle of circumference P viewed from the center of the pressure roller 251. If the contact angle (contact length) of the fixing belt 254 and pressure roller 251 is increased, the fixing nip is also enlarged. In this case, since it becomes easier to transfer heat to the toner on the paper, the temperature of the fixing heater can be set low, and reduction in electric power consumption and warm-up time can be achieved. However, if the side with the unfixed toner image is scraped on the fixing belt 254 before the paper enters the fixing nip, the image is damaged.

Therefore, in the third embodiment, the paper conveyance direction A1 directed by the transfer conveyance belt device 220 is to be directed to the starting point d of the fixing nip. The paper conveyed by the transfer conveyance belt device 220 thus smoothly enters through the nip, and this prevents the unfixed toner image on the paper from being scraped on the fixing belt 254 before the paper enters the fixing nip, without damaging the image. Here, angle $\alpha$ in the figure, indicates the paper conveyance angle (angle of incidence from the horizontal direction).

In the third embodiment, since the transfer conveyance belt device 220 is placed diagonally and different colors of image formation sections 204M, 204C, 204Y and 204Bk are laid out along the diagonal angle, the paper-feed section can be provided at the bottom of the main body, and the paper-ejection section can be provided at the top of the main body. Therefore, the paper conveyance path can be shortened contributing to reduction in printing time, or the like. In this layout, since the paper conveyance direction directed by the transfer conveyance belt device 220 is changed at the fixing device 250, the apparatus is compatible with various ways of paper conveyance following the fixing process.

The present invention should not be limited to the third embodiment shown above in the figure. For example, as a heat source of the fixing device, the heater may be an induction heater or a resistance heater, instead of a halogen lamp.

Moreover, the number of image formation sections in the image formation unit 203 may be two or three. Of course, the image apparatus does not have to be a printer, and may also be a copier, a facsimile machine, or the like.

Figure 9:
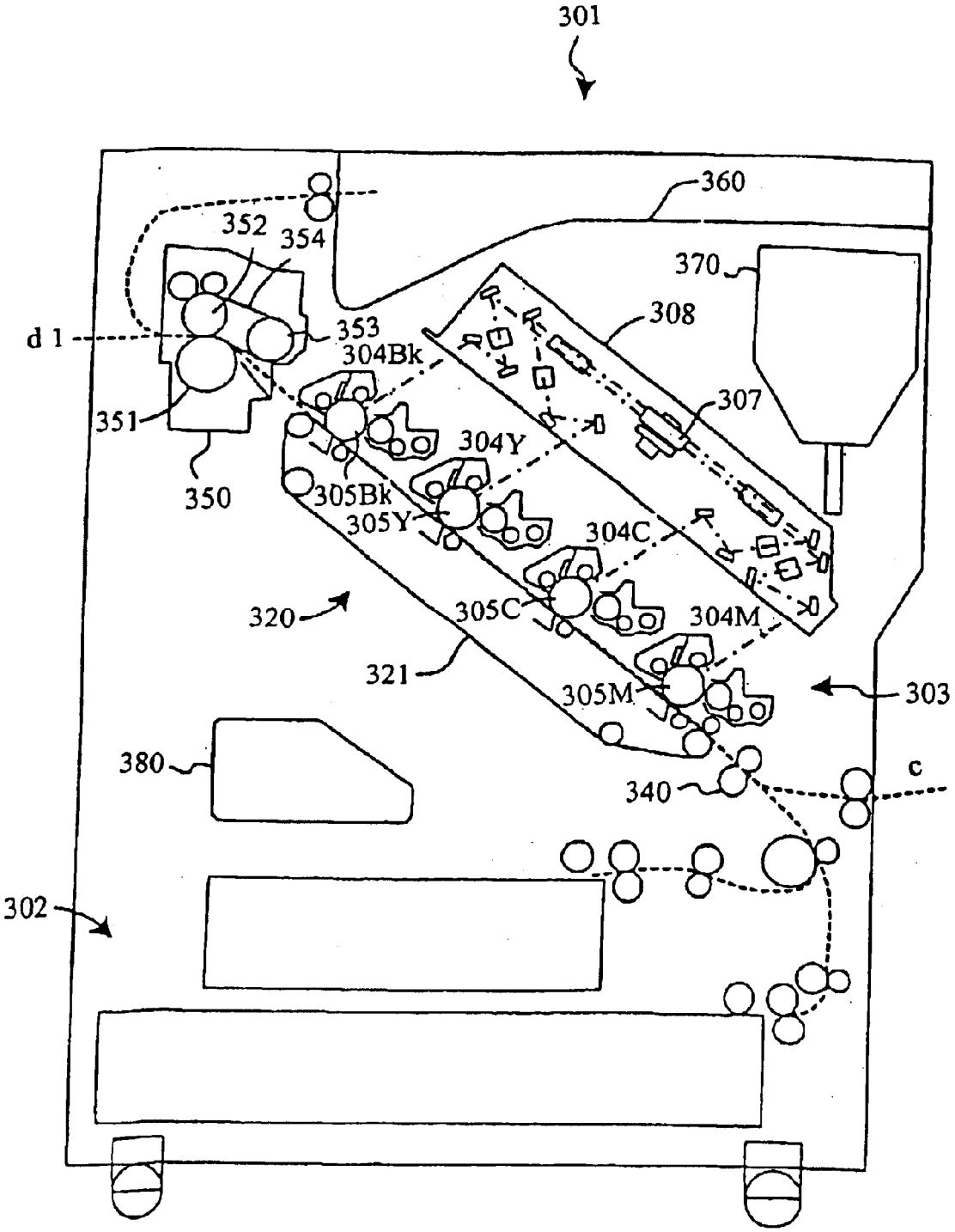
FIG. 9 is a cross section diagram showing schematic structure of a color laser printer which is one example of an image formation apparatus according to a fourth embodiment.

FIG. 9 is a cross-section diagram showing a schematic structure of a color laser printer that is one example of an image formation apparatus according to a fourth embodiment. This color laser printer 301 is provided with a paper-feed section 302 at the bottom section of the apparatus main body, and an image formation unit 303 above the paper-feed section 302. On the top face of the apparatus, a paper-ejection tray 360 is provided. Along a conveyance path of recording paper shown in the diagram by a broken line, the paper is fed from the paper-feed section 302, an image formed at the image formation unit 303 is transferred onto the paper and fixed by a fixing device 350, and the paper is ejected out to the paper-ejection tray 360. Manual paper-feed (shown by a reference symbol c) from the side of the apparatus, and paper-ejection to the side of the apparatus (shown by a reference symbol d1) are also possible.

In the image formation unit 303, a transfer conveyance belt device 320 is provided slanted in such a way that the paper-feed side is at the bottom and the paper-ejection side is at the top. Along the top side of this transfer conveyance belt device 220, four image formation sections for magenta (M), cyan (C), yellow (Y), and black (Bk), 304 M, 304C, 304Y, and 304 Bk, respectively in that order from the bottom, are provided side by side.

Since structures of the image formation sections, 304M, 304C, 304Y, and 304Bk, are identical, the image formation section 304C for cyan, will be explained in detail as an example.

Figure 10:
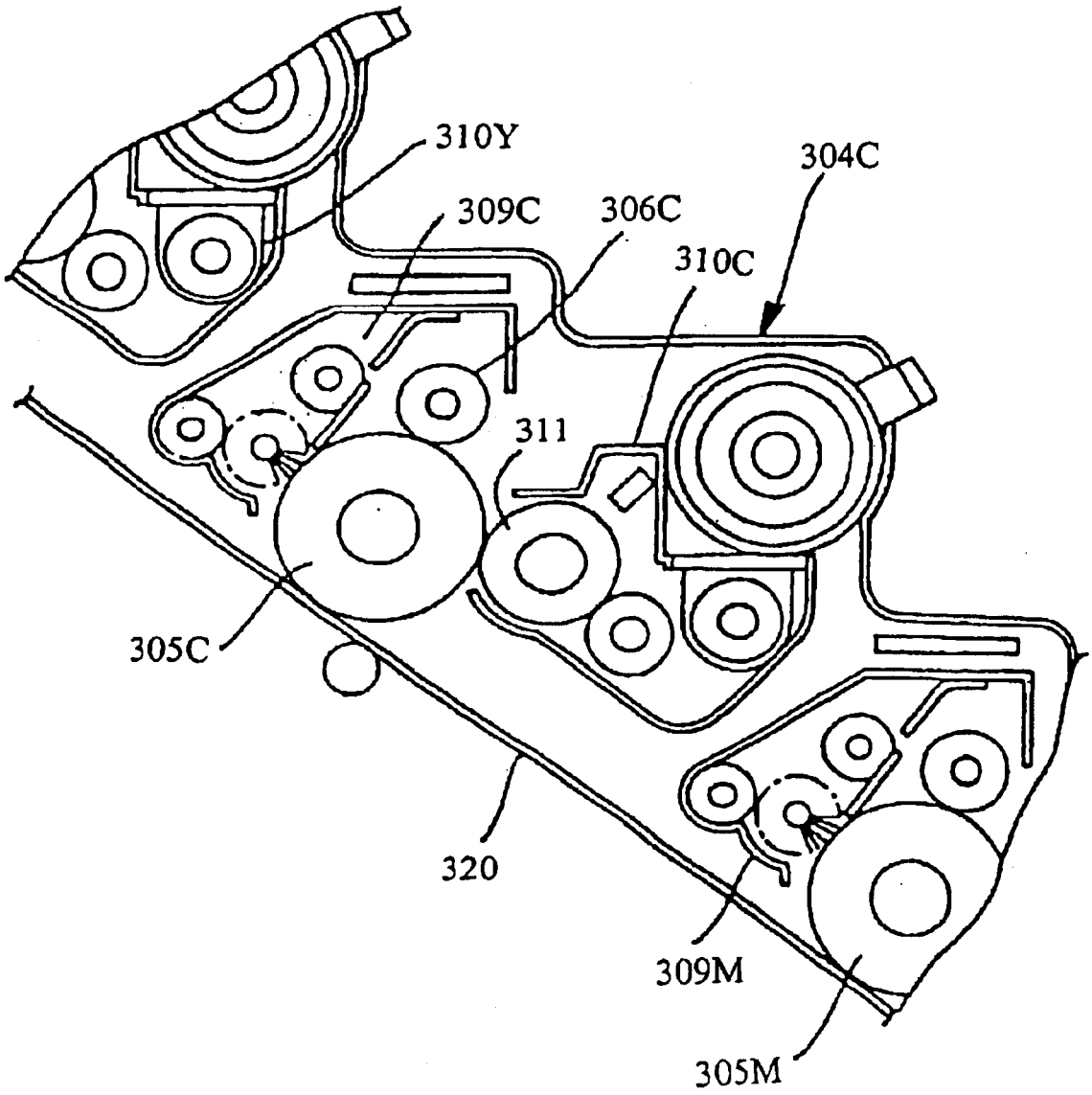
FIG. 10 shows elements on larger scale representing details of an image formation unit according to the fourth embodiment.

As shown in FIG. 9 and FIG. 10, the image formation section 304C has a photosensitive drum 305C as an image substrate, and the photosensitive drum 305C is rotary-driven in a clockwise direction in the diagram by a drive unit not shown. Around the photosensitive drum 305C, a charge roll 306C, a development device 310C, a cleaning device 309C and the like are provided. The development device 310C is a two-component development device, comprising a toner and a carrier, which attaches the toner held on a development roll 311 onto the photosensitive drum 305C. Laser beam from a light recording device 308, is radiated through between the charge roll 306C and development roll 311 onto the photosensitive drum 305C. In FIG. 9 and FIG. 10, to each of the reference numerals for members of the image formation section of each color, a symbol (M, C, Y, or Bk) is added after it to indicate the color.

Figure 11:
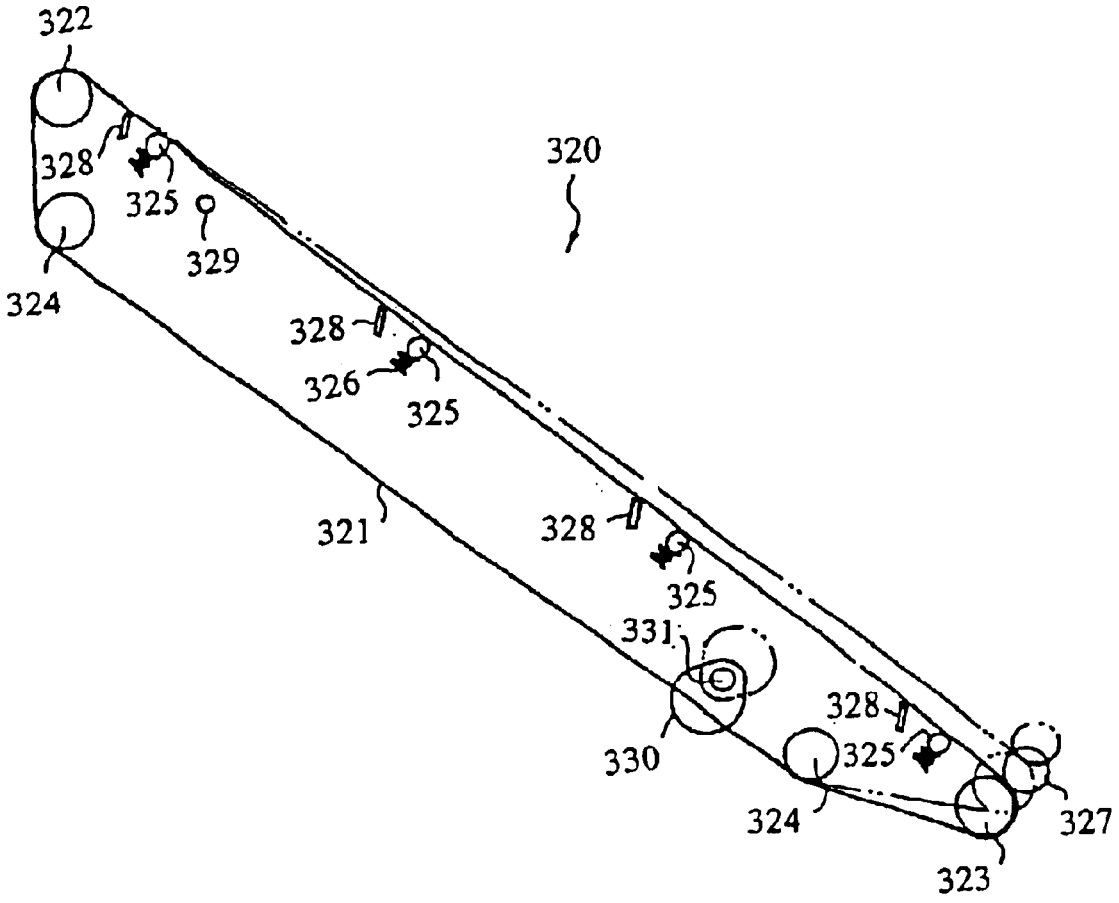
FIG. 11 is a side view showing structure of a transfer conveyance belt device according to the fourth embodiment.

FIG. 11 is a side view showing the structure of the transfer conveyance belt device.

As shown in the figure, the transfer conveyance belt 321 with an endless loop shape, extends tensioned around a drive roller 322, a driven roller 323 and two opposing rollers 324. A spring not shown in the diagram is provided onto the driven roller 323, and the transfer conveyance belt 321 is tensioned. Along the top side of the transfer conveyance belt device 321, four auxiliary rollers 325 are provided, and each auxiliary roller 325 is pressured onto the belt 321 by a coil spring 326. In a position slightly higher than each auxiliary roller 325, a transfer brush 328 is each placed touching the belt 321. The positions of the four transfer brushes correspond to the those of the photosensitive drums 305 of the color image formation sections respectively. A transfer bias of 7 kV is applied onto the transfer brushes 328 in this example. Further, a paper-adsorptive roller 327 is provided on top of the driven roller 323 with the belt 321 in between. The recording paper is fed onto the belt 321 through between the driven roller 323 and adsorptive roller 327, and conveyed being adsorbed to the transfer conveyance belt 321 electrostatically by the bias voltage applied to the adsorptive roller 327.

Figure 12:
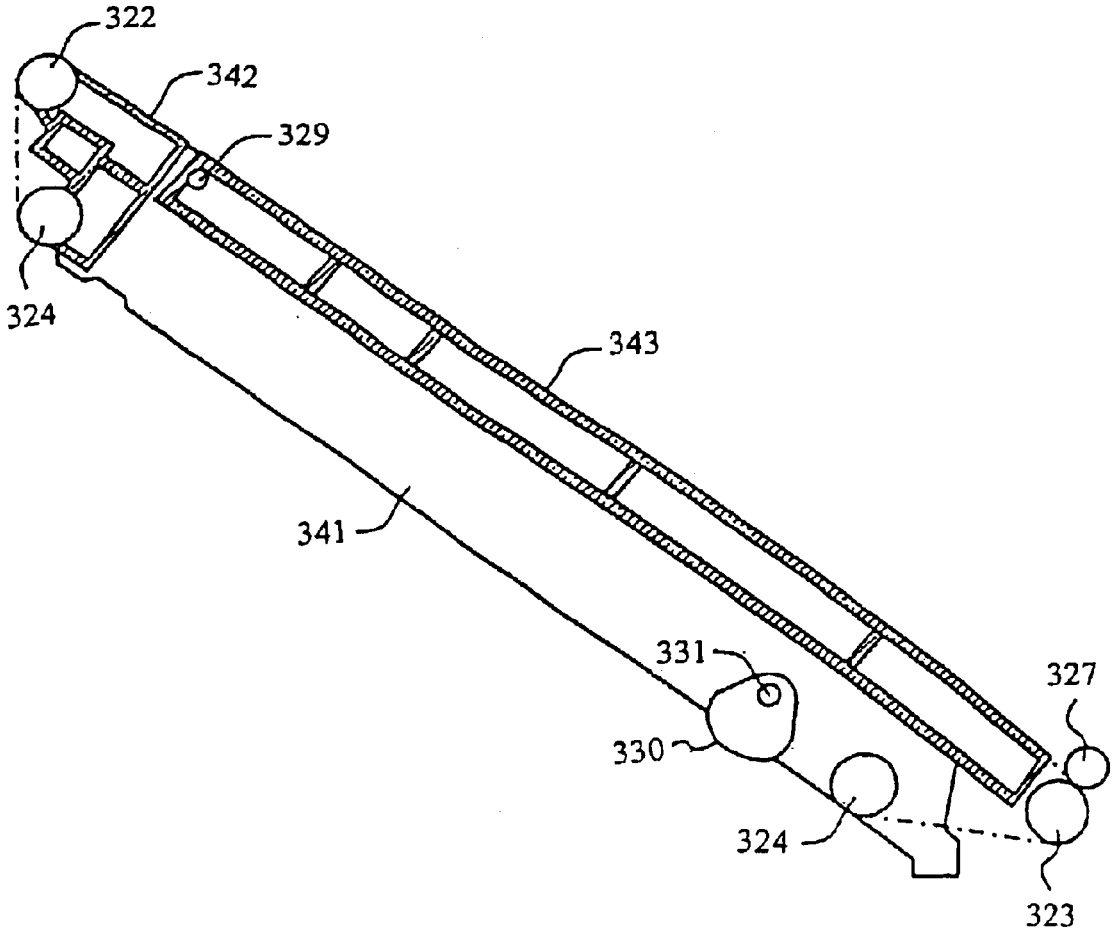
FIG. 12 is a cross section diagram showing a framework of the transfer conveyance belt device according to the fourth embodiment.

As shown in FIG. 12, framework of the transfer conveyance belt device 320 comprises fixed frames 341, a black-color frame 342, and a three-color frame 343. The fixed frames 341 are provided in the front and the back sides of the apparatus, supporting the black-color frame 342 and the 3-color frame 343. In the figure, only the back fixed frame is shown, omitting the front frame. The black-color frame 342 is an upper frame in a position corresponding to the image formation section 304Bk, and supports a drive roller 322, an upper opposing roller 324, and the like. The black-color frame 342 can be rotated around the axis of the drive roller 322. The three-color frame 343 is a frame in a position corresponding to the image formation sections 304M, 304C, and 304Y, and the three lower transfer brushes 328 and auxiliary rollers 325 are attached to the frame. The three-color frame 343 is supported by the fixed frame 341 slidably around a central axis 329. An eccentric cam 330 on the fixed frame 341 is supported around an axis. A reference numeral 331 indicates an axis of the eccentric cam 330. The axis 331 of the eccentric cam slidably supports a bracket 338 (see FIG. 13) and this bracket 338 supports the driven roller 323 and the adsorptive roller 327. The lower opposing roller 324 is mounted on the fixed frame 341.

Figure 13:
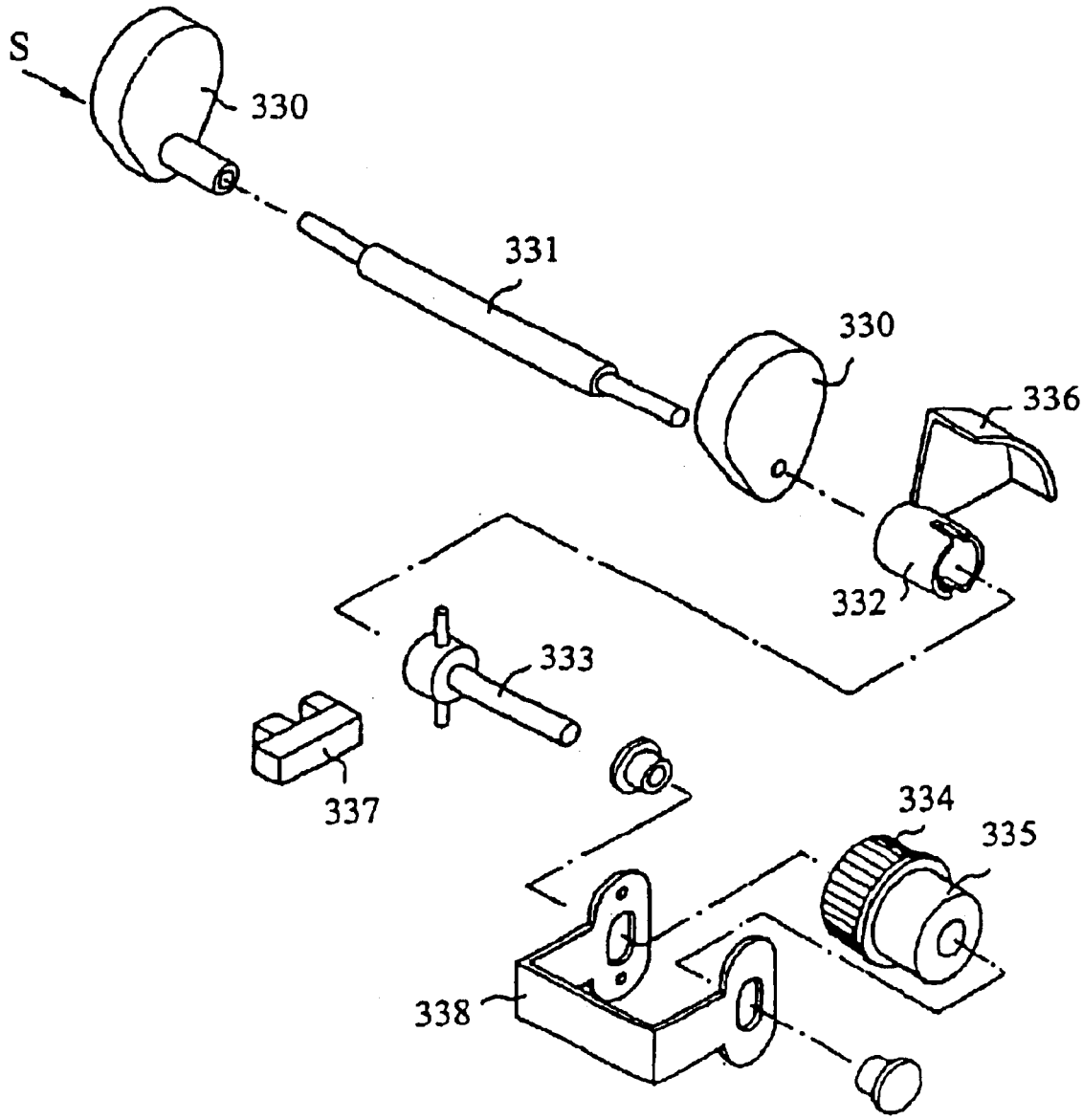
FIG. 13 is a perspective view showing an engagement mechanism of the transfer conveyance belt device according to the fourth embodiment.

FIG. 13 is a perspective view showing an engagement mechanism of the transfer conveyance belt device 320. In FIG. 13, the upper portion of the figure represents the front side of the printer main body, and the lower portion of the figure represents the back side of the printer main body. Therefore, FIG. 11 is a side view of the transfer conveyance belt device 320 observed from a direction indicated by an arrow S of FIG. 13.

As shown in FIG. 13, the eccentric cams 330 are fixed onto both sides of the axis 331.

A joint 332 is fixed outside the eccentric cam 330 at the back side of the apparatus. There is a junction axis 333 with a protrusion that can fit into the joint 332, and a gear 334 is fixed to the junction axis 333. A clutch 335 is attached to the gear 334, and transmits and releases the driving force coming from a motor not shown in the diagram to the gear 334. A feeler section 336 is provided on the joint 332, and a photointerrupter 337 is also provided for detecting the feeler section 336. The bracket 338 for supporting the driven roller 323 and the adsorptive roller 327 is fitted with the junction axis 333.

In FIG. 13, when the gear 334 is rotated by a motor not shown in the diagram, the axis 331 and the eccentric cam 330 are rotated via the junction axis 333 and the joint 332, to lift or lower the three-color frame 343 of the above-described transfer conveyance belt device 320. As the bracket 338 oscillates, the driven roller 323 and the adsorptive roller 327 are also lifted or lowered. As the feeler section 336 is detected by the photointerrupter 337, the state of the eccentric cam 330 is detected in order to control the posture of the transfer conveyance belt device 320.

As shown in FIG. 11, in the transfer conveyance belt device 320 having this kind of structure, the three-color frame 343 oscillates up and down around the axis 329 as the eccentric cam 330 rotates. As the three-color frame 343 moves up and down, the bracket moves up and down, and the driven roller 323 and the adsorptive roller 327 are shifted into positions shown by a solid line and a broken line.

As the eccentric am 330 rotates and moves into the position indicated by the broken line, the three-color frame 343 is lifted up by the eccentric cam 330 thereby lifting the bracket supporting the driven roller 323 and the adsorptive roller 327, such that the driven roller 323 and the adsorptive roller 327 move into the position shown by the broken line. The top side of the transfer conveyance belt 321 is therefore lifted up to a position shown with the broken line, contacting (the photosensitive drums 305 of) the four colors of image formation sections 304M, 304C, 304Y, and 304Bk. The three lower auxiliary rollers 325 loaded on the three-color frame 343 are also lifted up and increases momentum of the top side of the transfer conveyance belt 321 from the inner side of the belt loop.

As the eccentric cam 330 rotates and comes into the position shown by the solid line in the figure, the three-color frame 343 is lowered, and the bracket 338 supported by the three-color frame 343 is also lowered, and the driven roller 323 and the adsorptive roller 327 come into the position shown by the solid line. In this case, the transfer conveyance belt 321 is in a state shown by the solid line, and only a predetermined region of the higher portion of the top side of the transfer conveyance belt 321 comes in contact with the black image formation section 304Bk, and the belt 321 is parted from the image formation sections 304M, 304C, and 304Y.

In other words, in the fourth embodiment, in case of color printing, the transfer conveyance belt 321 is kept in the position contacting (the photosensitive drums of) the four colors of image formation sections 304M, 304C, 304Y, and 304Bk. In case of black monochrome printing, the transfer conveyance belt 321 is kept in the position touching (the photosensitive drum of) the image formation section 304Bk only.

In case of black monochrome printing (monochrome mode), which is generally the most frequently used printing, the transfer conveyance belt 321 is contacted with (the photosensitive drum of) the black image formation section 304Bk only, and parted from (the photosensitive drums of) the other color image formation units 304M, 304C, and 304Y, as described above. Therefore, the image formation sections 304M, 304C, and 304Y that are not required in formation of monochrome images do not have to be activated and life-cycles of the members involved in these three image formation sections, especially their photosensitive drums, are not shortened.

The black-color frame 342 of the transfer conveyance belt device 320 does not oscillate in accordance with the eccentric cam 330. In the fourth embodiment, the black-color frame 342 and the three-color frame 343 are configured in such a way that they are displaced separately. Thus, in case of black-and-white mode (monocolor printing), even if the three-color frame 343 is rotated to lower the part corresponding to the position of the image formation sections 304M, 304C, and 304Y, the part of the transfer conveyance belt 321 corresponding to the position of the black image formation section 304Bk, can be sustained in the correct position against the photosensitive drum of the black image formation section 304Bk, to achieve correct transfer of image. Of course, in case of color mode, the part corresponding to the position of the black image formation section 304Bk can be maintained in its correct position also.

Printing operations according to the fourth embodiment will now be explained while referring to FIG. 9 and FIG. 10.

In the image formation section 304M for magenta, surface of the photosensitive drum 305 is charged evenly to a predetermined potential with the charge roll 306. In the light recording device 308, an LD (laser diode) not shown in the figure is driven according to image data sent from a host machine such as a personal computer or the like. The laser beam illuminates a polygon mirror 307, and reflected light is lead to the photosensitive drum 305M via a cylinder lens or the like, to form an electrostatic latent image to be developed on the photosensitive drum 305M with a magenta toner. The toner from the development device 310 is attached to this latent image, to form a visible image of magenta toner.

Paper that has been specified as a transfer material is fed from the paper-feed section 302, and the fed paper strikes against the resistant roller pair 340 provided upstream of the conveyance direction of the transfer conveyance belt device 320, first. In case of color printing, in the transfer conveyance belt device 320, as explained above, the transfer conveyance belt 321 is pushed up. The paper is then fed onto the belt 321 in sync with the above-mentioned visible image, and reaches a transfer position opposite to the photosensitive drum 305M, as the belt conveys. In this transfer position, under the influence of the transfer brush 328 arranged on the reverse side of the transfer belt 321, the visible image of magenta toner is transferred onto the paper.

The visible image of each toner is formed on surface of each photosensitive drum 305, for every other image formation unit, 304C, 304Y, or 304Bk, as in the case of magenta color. As the paper conveyed by the transfer conveyance belt 321 reaches each transfer position, the visible image is transferred superimposing each image. In the color printer according to the fourth embodiment therefore, transfer and superimposing of full-color images can be done in a short period of time that is approximately equal to that of monochrome printing.

In case of monochrome printing, in the transfer conveyance belt device 320, as explained already, the transfer conveyance belt 321 is lowered, and the belt 321 is in contact with (the photosensitive drum of) the image formation section 304Bk only. Only in the image formation section 304Bk for black color, a visible image of black toner is formed on surface of the photosensitive drum 305Bk, and the black toner image is transferred onto the paper that is fed onto the belt 321 in sync with this black visible image.

In the fourth embodiment, as explained above, in case of color-mode printing, the transfer conveyance belt 321 comes in contact with the photosensitive drums of all the image formation sections, and in case of monochrome printing, the belt 321 is parted from the photosensitive drums of the three lower image formation sections (304M, 304C, and 304Y) In the color-mode printing wherein all the photosensitive drums contact the conveyance belt, since the paper is conveyed held between each photosensitive drum and the conveyance belt (and when the conveyance belt and the photosensitive bodies are to be contacted with each other, the photosensitive bodies are rotary-driven to avoid being damaged), it becomes advantageous in terms of paper conveyance. Furthermore, in the fourth embodiment, as explained above, since the paper is electrostatically adsorbed onto the transfer conveyance belt 321 by applying a bias voltage from the paper adsorptive roller, even in case of the monochrome printing wherein the belt 321 is parted from the three lower photosensitive drums, the paper can be conveyed stably.

The paper after transferring the toner image, leaves the transfer conveyance belt 321, and the image is fixed, in the fixing device 350. The fixing device of this example is a belt fixing system, wherein: a fixing roller 352, composed of a comparatively soft material, for example, sponge, is pressed against a rigid pressure roller 351; and a belt 354 is wound around the fixing roller 352 and a heat roller 353 that is placed upstream of the paper conveyance direction. In this belt fixing system, there is an advantage that time needed for warm-up is short in contrast to a roller fixing system.

The paper after fixing is ejected out to the paper-ejection tray 360 provided on the top face of the apparatus main body. When the paper is ejected, the paper is reversed and ejected facedown. Facedown paper-ejection is a prerequisite for collating the order of pages in printing.

The color printer according to the fourth embodiment is provided with four image formation sections 304M, 304C, 304Y, and 304Bk, and the respectively colored toner images are sequentially transferred onto the paper such that the images are superimposed, while the paper is conveyed by the transfer conveyance belt device 320. Therefore, in contrast to a system wherein the toner images are transferred on top of each image onto an intermediate transfer body using a single image formation section and subsequently transferring the acquired image on to the paper, time required for image formation can be significantly reduced in the color printer according to the fourth embodiment.

In the fourth embodiment, since the transfer conveyance belt device 320 is placed diagonally, and the color image formation sections 304M, 304C, 304Y, and 304Bk are laid out along the slanted direction, the paper-feed section can be placed at the bottom of the main body and the paper-ejection section can be placed on the top of the main body. As a result, the paper conveyance paths can be shortened, and this is preferable in terms reduction of time required for printing or the like. In this diagonal layout, since triangular spaces are created in the corners of the apparatus, toner container 370 with a high degree of freedom of shape, or a disposal tank 380 may be provided in forms corresponding to the triangular spaces, to avoid creation of dead space.

Figure 14:
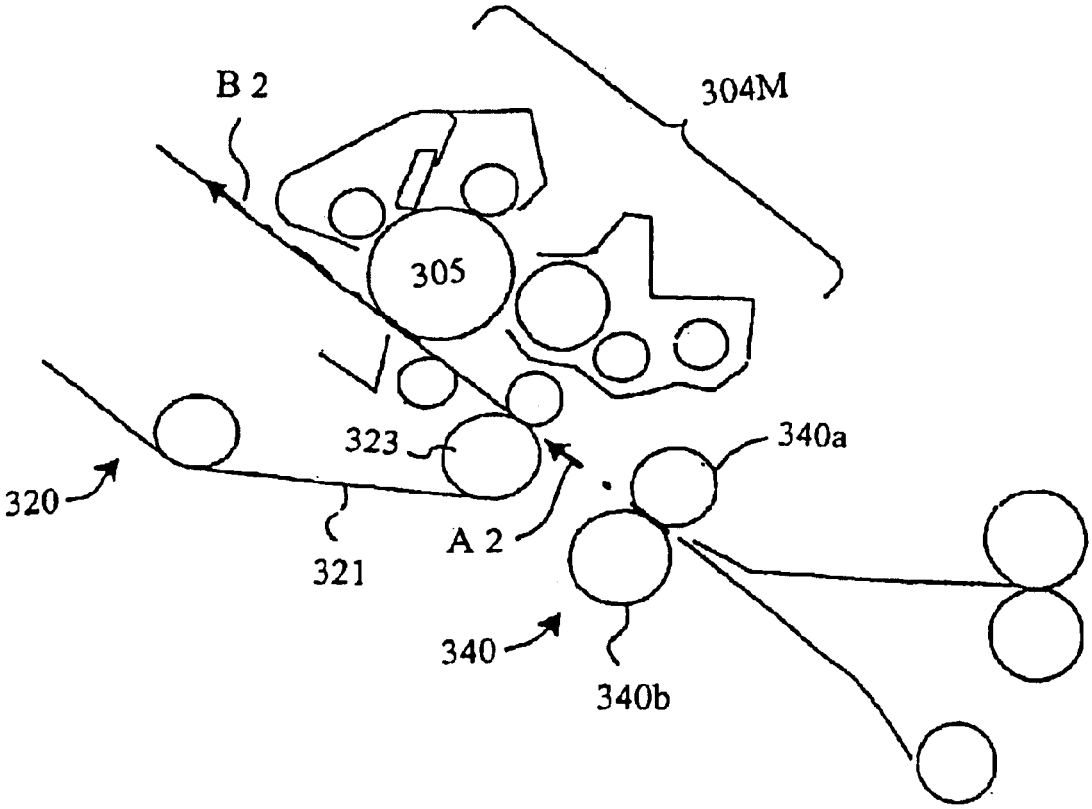
FIG. 14 is a diagram for explaining partial details of a function according to the fourth embodiment.

In the fourth embodiment, as shown in FIG. 14, the paper conveyance direction A2 directed by the resistant roller pair 340 comprising a resistant drive roller 340*a* and a resistant driven roller 340*b*, is to be approximately identical to the paper conveyance direction B2 directed by the transfer conveyance belt device 320. As a result, in the process wherein the paper moves from the resistant roller pair 340 to the transfer conveyance belt device 320, conveyance of the paper is not adversely affected, and variation of image positions against the paper will be avoided such that high-quality images can be obtained. In particular, in case of color printing, since the apparatus is configured in such a manner that the paper conveyance direction A2 and the paper conveyance direction B2 are approximately the same, the color images transferred on top of each other does not become out of color registration, and high-quality color image can be obtained.

If there is misalignment in the paper conveyance directions directed by the resistant roller pair and the transfer conveyance belt device, the paper is bent in the middle when both the transfer conveyance belt device and the resistant roller pair hold the paper. Therefore, in case of using, for example, a firm recording material, in the instant that the trailing end of the recording material leaves the resistant rollers, the trailing end tends to go in the paper conveyance direction directed by the transfer conveyance device, causing a slight vibration in some cases. As a result, variation in the image position against the recording material may be caused, and since accurate color registration in order of microns (approximately 80 $\mu$m) is required particularly in color image formation, this variation results in a big problem that the image obtained becomes out of color registration. However, as explained above, in the fourth embodiment, in case of color printing, the paper conveyance directions A2 and B2 are approximately equal, and thus high-quality images with accurate color registration can be obtained.

In particular, the effect that variation in the image position against the recording material can be avoided, is significantly appreciated for the color image formation apparatus having the system wherein multiple image formation sections are placed side by side, and different colors of images are sequentially transferred on top of each image as the paper is conveyed, like the system in the fourth embodiment.

When the apparatus has the layout like in the fourth embodiment wherein the transfer conveyance belt device 320 is placed diagonally, and the color image formation sections are placed along this diagonal direction, by making the paper conveyance direction A2 and B2 approximately identical, the resistant roller pair 340 can be placed adjacent to the transfer conveyance belt device 320, and the volume covering this space can be made compact, thereby contributing to downsizing of the apparatus.

The present invention has been explained while referring to the fourth embodiment shown in the figures, however, the embodiment should not be limited to the explanation. For example, the mechanism for controlling the posture of the transfer conveyance belt device may have any suitable configuration. Further, the medium for detecting the posture may also have any suitable configuration. Moreover, the unit for applying the bias for adsorbing the recording material may be of any form, including a non-contact system, instead of the contact system. Furthermore, number of the image formation sections does not have to be four. Of course, the image formation apparatus maybe a copier, or a facsimile machine, instead of a printer.

As explained above, according to the invention, since the image formation unit is placed diagonally in relation to the vertical direction, the small-size paper-feed tray is placed below the unit, and the largest paper-feed tray is placed below the small-size paper-feed tray, the space within the breadth which is determined by the maximum usable paper size can be efficiently used, achieving reduction of space required for the apparatus.

Further, according to the invention, since the positions of the paper-feed sections of the largest paper-feed tray and the small-size paper-feed tray are offset from each other, increase in height of the apparatus can be avoided.

Further, according to the invention, since the paper is conveyed downward first from the paper-feed section of the small-size paper-feed tray, it is effective against increase in height of the apparatus.

Further, according to the invention, since the space within the breadth that is determined by the maximum usable paper size can be efficiently used, the tandem color image formation apparatus wherein reduction of space required for the apparatus is achieved, can be provided.

Further, according to the invention, since the image formation unit, the transfer unit and the duplex conveyance unit are placed diagonally in relation to the vertical direction, the breadth of the apparatus can be decreased, and reduction of the apparatus volume can be achieved. The effect provided by the diagonal arrangement of, the image formation unit, the transfer unit and the duplex conveyance unit, is not cancelled by the paper reversal section because the duplex reversal unit is placed on the side of the apparatus, and the sides of the transfer paper are reversed along the vertical direction, and the breadth of the whole apparatus will not be enlarged even if the paper reversal mechanism is to be provided.

Further, according to the invention, since the duplex conveyance unit can be withdrawn in front of the apparatus, any jamming caused inside the duplex conveyance unit can be easily fixed.

Further, according to the invention, since the duplex conveyance unit and the transfer unit can be withdrawn integrated with each other, any jamming caused inside the duplex conveyance unit and between the image formation unit and transfer unit can be fixed at the same time.

Further, according to the invention, since the duplex conveyance unit can be opened and closed, any jamming caused inside the duplex unit can be easily fixed.

Further, according to the invention, the breadth of the apparatus can be decreased, and the tandem color image formation apparatus wherein reduction of the apparatus volume can be achieved, can be provided.

Further, according to the invention, in the image formation apparatus with the configuration wherein the transfer conveyance belt device is placed diagonally, since the conveyance direction of the recording material conveyed from the transfer conveyance belt device can be changed at the fixing nip of the heat fixing device before the recording material is ejected out of the fixing device, the apparatus can handle various ways of paper conveyance following the fixing process. Further, even if the conveyance direction of the recording material is changed, the unfixed toner image on the paper is not damaged before the image is fixed.

Further, according to the invention, since the ejection direction of the recording material from the heat fixing device is approximately horizontal, the apparatus is able to evenly handle various ways of paper conveyance that come after the fixing process, such as conveying the paper in an upward, a continuously horizontal, or a downward direction, and the paper conveyance path toward any direction does not have to be lengthened.

According to the configuration of the invention, since the conveyance direction of the recording material is changed from that directed by the transfer conveyance belt device toward the side holding the image to be fixed before it is ejected out of the heat fixing device, the image immediately after being fixed, is not touched by the members of the apparatus, and thus, change in the paper conveyance direction can be achieved without affecting the image.

Further, according to the configuration of the invention, since the heat fixing device is of the belt fixing system, the ejection direction of the recording material out of the heat fixing device can be altered from the conveyance direction directed by the transfer conveyance belt device.

Further, according to the configuration of the invention, the ejection direction of the recording material can be set easily with the fixing device of the belt fixing system.

Further, according to the configuration of the invention, since the conveyance direction of the recording material conveyed by the transfer conveyance belt device is directed toward the starting point of the fixing nip of the heat fixing device, the paper enters the nip smoothly, and the unfixed toner image is not brushed before the paper enters the fixing nip and not damaged.

According to the invention, since the heat fixing device comprises a pair of roller members that are pressed onto each other, wherein one of the member is softer than the other, the paper conveyance direction can be easily changed at the fixing nip.

Further, according to the invention, since the posture of the transfer conveyance belt device is controllable, and in case of color-mode printing, the posture is controlled in such a manner that the conveyance direction of the recording material directed by the transfer conveyance belt device is approximately identical to that directed by the resistant unit, no adverse effects are caused to the conveyance during the delivery process from the resistant unit to the transfer conveyance device. In the case of color-mode printing where the image being out of color registration is a big problem, the variation in the image position against the recording material can be avoided to obtain a high-quality color image. Moreover, since the transfer conveyance belt device can be placed adjacent to the resistant unit, such that volume of the apparatus can be reduced.

Further, according to the configuration of the invention, since in the transfer conveyance belt device, the section that is opposite to the image substrate for forming black image, and the section that is opposite to the image substrates for forming other color images can be displaced individually, the section of the belt corresponding to the black image formation section of the image formation unit can be sustained in its correct position in case of black and white mode (mono-color) printing.

In the configuration according to the invention, in case of monochrome mode printing, since the conveyance belt of the transfer conveyance belt is contacted with the image substrate for forming the black image and parted from the image substrates for forming the other color images, exhaustion of the image substrates that are unnecessary for monochrome printing and shortening of life-cycle of the image substrates can be avoided.

Further, according to the configuration of the invention, since the apparatus comprises the detection unit for detecting the posture of the transfer conveyance belt device and controls the posture of the transfer conveyance belt device according to the output of the detection unit, the posture of the transfer conveyance belt device can be accurately and correctly controlled.

Further, according to the configuration of the invention, since the conveyance belt of the transfer conveyance belt device is provided with the unit for applying a bias to absorb the recording material onto the belt, the paper can be conveyed stably at all times. In particular, even in monochrome mode, wherein some of the image substrates are parted from the transfer conveyance belt, the paper can be conveyed stably.

Further, according to the configuration of the invention, since the transfer conveyance belt device is placed diagonally such that the heights of the inlet and the outlet for the recording material are different, the paper conveyance path can be shortened, and this is advantageous in terms of reduction in time required for printing. Moreover, the delivery of the recording material from the resistant unit to the transfer conveyance belt device can be done properly when the transfer conveyance belt device is arranged diagonally.

The present document incorporates by reference the entire contents of Japanese priority documents, 2000-293938 filed in Japan on Sep. 27, 2000, 2000–293937 filed in Japan on Sep. 27, 2000, 2000-333272 filed in Japan on Oct. 31, 2000, 2000-363163 filed in Japan on Nov. 29, 2000, 2001-261950 filed in Japan on Aug. 30, 2001, 2001–261951 filed in Japan on Aug. 30, 2001 and 2001-261952 filed in Japan on Aug. 30, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A color image formation apparatus comprising:

a case;

an image formation unit disposed diagonally in relation to a vertical direction;

a paper-feed section disposed below said image formation unit and adapted to feed paper toward image formation sections of said image formation unit;

a transfer unit disposed parallel and opposite to said image formation unit;

a duplex reversal unit disposed on a side of the apparatus, the duplex reversal unit adapted to reverse the paper after the paper has passed through said transfer unit; and a duplex conveyance unit disposed below and removably attached to said transfer unit, the duplex conveyance unit adapted to feed the reversed paper toward said image formation sections, wherein the duplex conveyance unit is adapted to be removed from the case while the duplex reversal unit remains in the case.

2. The color image formation apparatus according to claim 1, wherein said duplex conveyance unit is adapted to be withdrawn out of a front of the case.

3. The color image formation apparatus according to claim 2, wherein said duplex conveyance unit comprises guide plates adapted to guide paper to be conveyed, said guide plates configured to be opened and closed relative to one another by rotating one of the guide plates around a fulcrum.

4. A color image formation apparatus comprising:

a case;

an image formation unit disposed diagonally in relation to a vertical direction;

a paper-feed section disposed below said image formation unit and adapted to feed paper toward image formation sections of said image formation unit;

a transfer unit disposed parallel and opposite to said image formation unit;

a duplex reversal unit disposed on a side of the apparatus, the duplex reversal unit adapted to reverse the paper after the paper has passed through said transfer unit; and a duplex conveyance unit disposed below said transfer unit and adapted to feed the reversed paper toward said image formation sections, wherein the duplex conveyance unit is adapted to be removed from the case while the duplex reversal unit remains in the case, wherein said duplex conveyance unit comprises guide plates adapted to guide paper to be conveyed, said guide plates configured to be opened and closed relative to one another by rotating one of the guide plates around a fulcrum, and wherein said duplex conveyance unit is adapted to be withdrawn from the case with said transfer unit.

5. The color image formation apparatus according to claim 4, wherein said duplex conveyance unit comprises guide plates adapted to guide paper to be conveyed, said guide plates configured to be opened and closed relative to one another by rotating one of the guide plates around a fulcrum.

6. A tandem color image formation apparatus comprising:

a case;

an image formation unit comprising image formation sections adapted to form images of different colors disposed diagonally in relation to a vertical direction;

a paper-feed section disposed below said image formation unit and adapted to feed paper toward the image formation sections of said image formation unit;

a transfer unit disposed parallel and opposite to said image formation unit a duplex reversal unit disposed on a side of the apparatus, the duplex reversal unit adapted to reverse the paper after the paper has passed through said transfer unit; and a duplex conveyance unit disposed below and removable attached to said transfer unit, the duplex conveyance unit adapted to feed the reversed paper toward said image formation sections, wherein the duplex conveyance unit is adapted to be removed from the case while the duplex reversal unit remains in the case.

7. A color image formation apparatus comprising:

a case;

an image formation unit disposed diagonally in relation to a vertical direction;

a paper-feed section disposed below said image formation unit and adapted to feed paper toward image formation sections of said image formation unit;

a transfer unit disposed parallel and opposite to said image formation unit;

a duplex reversal unit disposed on a side of the apparatus, the duplex reversal unit adapted to reverse the paper after the paper has passed through said transfer unit;

a duplex conveyance unit disposed below said transfer unit and adapted to feed the reversed paper toward said image formation sections; and a connection disposed between the transfer unit and the duplex conveyance unit, the connection adapted to permit removal and the transfer unit and the duplex conveyance unit from the case and to permit removal of the transfer unit from the duplex conveyance unit, wherein the duplex conveyance unit is adapted to be removed from the case while the duplex reversal unit remains in the case.

8. The color image formation apparatus according to claim 7, wherein the connection comprises a rail disposed in the case.

9. The color image formation apparatus according to claim 8, wherein the transfer unit further comprises a roller, and the duplex conveyance unit further comprises a guide, the roller and the guide connected to the rail.

10. The color image formation apparatus according to claim 9, wherein the rail comprises a groove adapted to removably retain the roller.

11. The color image formation apparatus according to claim 8, wherein the transfer unit comprises a protrusion, and the duplex conveyance unit comprises a guide, the protrusion and the guide connected to the rail.

12. The A color image formation apparatus comprising:

a case;

an image formation unit disposed diagonally in relation to a vertical direction;

a paper-feed section disposed below said image formation unit and adapted to feed paper toward image formation sections of said image formation unit;

a transfer unit disposed parallel and opposite to said image formation unit;

a duplex reversal unit disposed on a side of the apparatus, the duplex reversal unit adapted to reverse the paper after the paper has passed through said transfer unit;

a duplex conveyance unit disposed below said transfer unit and adapted to feed the reversed paper toward said image formation sections;

a fixed rail connected to the case;

a movable rail slidable on the fixed rail;

a first connection connecting the transfer unit and the movable rail, the first connection permitting removal of the transfer unit from the duplex conveyance unit; and a second connection connecting the duplex conveyance unit and the movable rail, the second connection permitting removal of the transfer unit and the duplex conveyance unit from the case, wherein the duplex conveyance unit is adapted to be removed from the case while the duplex reversal unit remains in the case.

13. The color image formation apparatus according to claim 12, wherein the first connection comprises one of a roller and a protrusion.

14. A color image formation apparatus comprising:

a case;

an image formation unit comprising image formation sections adapted to form images of different colors disposed diagonally in relation to a vertical direction;

a paper-feed section disposed below said image formation unit and adapted to feed paper toward the image formation sections of said image formation unit;

a transfer unit disposed parallel and opposite to said image formation unit;

a duplex reversal unit disposed on a side of the apparatus, the duplex reversal unit adapted to reverse the paper after the paper is has passed through said transfer unit;

a duplex conveyance unit disposed below said transfer unit and adapted to feed the reversed paper toward said image formation sections; and a connection disposed between the transfer unit and the duplex conveyance unit, the connection adapted to permit removal and the transfer unit and the duplex conveyance unit from the case and to permit removal of the transfer unit from the duplex conveyance unit, wherein the duplex conveyance unit is adapted to be removed from the case while the duplex reversal unit remains in the case.

15. The color image formation apparatus according to claim 14, wherein the connection comprises a rail disposed in the case.

16. The color image formation apparatus according to claim 15, wherein the transfer unit further comprises a roller, and the duplex conveyance unit further comprises a guide, the roller and the guide connected to the rail.

17. The color image formation apparatus according to claim 16, wherein the rail comprises a groove adapted to removably retain the roller.

18. The color image formation apparatus according to claim 15, wherein the transfer unit comprises a protrusion, and the duplex conveyance unit comprises a guide, the protrusion and the guide connected to the rail.

19. A color image formation apparatus comprising:

a case;

an image formation unit comprising image formation sections adapted to form images of different colors disposed diagonally in relation to a vertical direction;

a paper-feed section disposed below said image formation unit and adapted to feed paper toward the image formation sections of said image formation unit;

a transfer unit disposed parallel and opposite to said image formation unit a duplex reversal unit disposed on a side of the apparatus, the duplex reversal unit adapted to reverse the paper after the paper is has passed through said transfer unit;

a duplex conveyance unit disposed below said transfer unit and adapted to feed the reversed paper toward said image formation sections;

a fixed rail connected to the case;

a movable rail slidable on the fixed rail;

a first connection connecting the transfer unit and the movable rail, the first connection permitting removal of the transfer unit from the duplex conveyance unit; and a second connection connecting the duplex conveyance unit and the movable rail, the second connection permitting removal of the transfer unit and the duplex conveyance unit from the case, wherein the duplex conveyance unit is adapted to be removed from the case while the duplex reversal unit remains in the case.

20. The color image formation apparatus according to claim 19, wherein the first connection comprises one of a roller and a protrusion.

* * * * *